US008614040B2

(12) United States Patent
Fukao et al.

(10) Patent No.: US 8,614,040 B2
(45) Date of Patent: Dec. 24, 2013

(54) ELECTROSTATIC IMAGE DEVELOPING TONER, TONER CONTAINER AND PROCESS CARTRIDGE

(75) Inventors: Tomohiro Fukao, Osaka (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/417,741

(22) Filed: Mar. 12, 2012

(65) Prior Publication Data

US 2012/0237253 A1 Sep. 20, 2012

(30) Foreign Application Priority Data

Mar. 17, 2011 (JP) ..... 2011-059679

(51) Int. Cl.
*G03G 15/08* (2006.01)

(52) U.S. Cl.
USPC ..... 430/108.1; 430/108.7; 430/110.1; 430/110.3

(58) Field of Classification Search
USPC ..... 430/108.1, 108.7, 110.1, 110.3
See application file for complete search history.

(56) References Cited

U.S. PATENT DOCUMENTS

| | | | |
|---|---|---|---|
| 7,829,254 | B2 | 11/2010 | Kurose et al. |
| 2008/0076054 | A1 | 3/2008 | Nozaki et al. |
| 2008/0096119 | A1 | 4/2008 | Yamamoto et al. |
| 2009/0220879 | A1 | 9/2009 | Matsumoto et al. |
| 2010/0055603 | A1 | 3/2010 | Nozaki et al. |
| 2011/0053063 | A1 | 3/2011 | Kadota et al. |
| 2011/0053077 | A1 | 3/2011 | Mikuriya et al. |
| 2011/0164901 | A1 | 7/2011 | Yamamoto et al. |
| 2011/0250533 | A1 | 10/2011 | Kadota et al. |
| 2011/0287356 | A1 | 11/2011 | Fukao et al. |

FOREIGN PATENT DOCUMENTS

| | | |
|---|---|---|
| JP | 8-106171 | 4/1996 |
| JP | 2708446 | 10/1997 |
| JP | 2750853 | 2/1998 |
| JP | 2838410 | 10/1998 |
| JP | 2003-202701 | 7/2003 |
| JP | 3938748 | 4/2007 |
| JP | 2008-90256 | 4/2008 |
| JP | 2008-191639 | 8/2008 |
| JP | 2008-276269 | 11/2008 |
| JP | 4298966 | 4/2009 |

OTHER PUBLICATIONS

Chinese Office Action issued Apr. 27, 2013, in China Patent Application No. 201210157269.1 (with English translation).

*Primary Examiner* — Mark F Huff
*Assistant Examiner* — Rachel Zhang
(74) *Attorney, Agent, or Firm* — Oblon, Spivak, McClelland, Maier & Neustadt, L.L.P.

(57) ABSTRACT

An electrostatic image developing toner including: toner particles; wherein the toner particles each contain: a core particle including a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of R1>R1' where, in a cross-section of the toner particle, R1' denotes an average diameter of openings of the first resin in which the second resin is embedded and R1 denotes an average diameter of the exposed regions.

16 Claims, 4 Drawing Sheets

ELECTROSTATIC IMAGE DEVELOPING TONER, TONER CONTAINER AND PROCESS CARTRIDGE

BACKGROUND OF THE INVENTION

1. Field of the Invention

The present invention relates to an electrostatic image developing toner for developing a latent electrostatic image formed in an electrophotographic method, an electrostatic recording method and an electrostatic printing method, a toner container, and a process cartridge.

2. Description of the Related Art

Dry-process developing devices using a powdery developing agent have widely been employed in image forming apparatuses such as electronic copiers, printers and facsimiles, in which a latent electrostatic image formed on a latent image bearing member is visualized with a developer to obtain a recorded image.

In recent years, color image forming apparatuses using electrophotographic process have broadly been employed, and digitized images are easily available. Thus, it is required to make an image to be printed at higher definition. While studying higher resolution and gradation of an image, as an improvement of a toner which visualizes a latent image, it has been studied to further conglobate and minimize in particle size for forming the image at high definition. And, since in the toners produced by the pulverizing methods, their conglobation and minimization are limited, so-called polymerized toners produced by a suspension polymerization method, an emulsification polymerization method and a dispersion polymerization method capable of conglobating and minimizing in particle size have been being employed.

Polymerization toners have a small particle diameter and thus, exhibit an increased adhesion force to members, which degrades transfer efficiency and causes filming. Also, the polymerization toners have a spherical shape and thus, are poor in cleanability. In addition, the polymerization methods allow toner materials of relatively low resistance to be localized near the toner surfaces. Therefore, the formed polymerization toners involve background smear due to their low chargeability. Meanwhile, in recent years, there has been increased demand for toners that attain high-quality images and have low-temperature fixing property for energy saving. Thus, a binder resin having a low melt temperature is desirably used. However, toners having a low-temperature fixing property possess newly arising problems such as generation of blocking at high-temperature, high-humidity environment, which is associated with degradation in heat resistance storage stability.

In view of this, attempts have been made to modify the surfaces of toner core particles to solve the aforementioned problems. The method for surface modification is, for example, dry methods in which fine particles are made to adhere onto the toner surfaces by the action of mechanical impact, and wet methods in which a resin dispersing agent is added to a dispersion liquid containing toner particles dispersed in a solvent, wherein the resin of the resin dispersing agent is different from the resin forming the toner particles. Regarding the dry methods, Japanese Patent (JP-B) No. 2838410 or other literatures disclose a toner including base particles and fine particles embedded in the surfaces thereof, wherein the toner is produced by adding the fine particles to the base particles heated to a temperature near their softening point, followed by stirring and mixing. Also, JP-B No. 2750853 discloses a toner including fine resin particles and core particles which are covered with the fine resin particles by the action of mechanical impact. Also, Japanese Patent Application Laid-Open (JP-A) No. 2008-191639 discloses a method of forming a coating layer by spraying a modifying material. However, any of these dry methods cannot suppress fine resin particles from being exfoliated due to, in particular, stress applied in the shear direction since the adhesion of the fine resin particles to toner particles are insufficient.

Regarding the wet methods, JP-A No. 2008-90256 discloses a method in which the surfaces of toner core particles formed of first resin particles and a colorant are partially or totally covered with second resin particles. Although this proposed method can suppress the resin particles from being exfoliated due to strong stress, the resin particles existing on the surfaces deform to cause changes in characteristics of the toner.

JP-A No. 2003-202701 discloses a method in which fine resin particles are added in advance to an aqueous phase for fusion to control the particle diameter. However, in this method, the fine resin particles are incorporated into toner core particles, and as a result, the toner core particles cannot be covered with the fine resin particles in such an amount that surface modifications are accomplished.

An object of the present invention is to provide an electrostatic image developing toner containing: toner particles; and fine resin particles attached on surfaces of the toner particles so that they are not exfoliated from the surfaces of the toner particles, thereby involving no change in toner properties during repeated use and forming high-quality images for a long period of time.

SUMMARY OF THE INVENTION

The present inventors have found that the above object can be achieved by an electrostatic image developing toner including: toner particles; wherein the toner particles each contain: a core particle including a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of $R1>R1'$ where, in a cross-section of the toner particle, $R1'$ denotes an average diameter of openings of the first resin in which the second resin is embedded and $R1$ denotes an average diameter of the exposed regions, and have completed the present invention. The toner of the present invention encompasses, as preferable ones, toner particles where the coverage rate of the exposed regions of the fine resin particles on the surface of the core particle is larger than the coverage rate of the embedded regions of the fine resin particles on the surface of the core particle.

That is, the present invention is as follows.

The electrostatic image developing toner of the present invention is an electrostatic image developing toner including: toner particles; wherein the toner particles each contain: a core particle including a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of $R1>R1'$ where, in a cross-section of the toner particle, $R1'$ denotes an average diameter of openings of the first resin in which the second resin is embedded and $R1$ denotes an average diameter of the exposed regions.

As will be clear from the following detail and specific description, the present invention can provide an electrostatic image developing toner containing: toner particles; and fine resin particles attached on surfaces of the toner particles so that they are not exfoliated from the surfaces of the toner particles, thereby involving no change in toner properties during repeated use and forming high-quality images for a long period of time.

DETAILED DESCRIPTION OF THE INVENTION (Toner)

An electrostatic image developing toner of the present invention includes: toner particles; wherein the toner particles each contain: a core particle including a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression R1>R1' where, in a cross-section of the toner particle, R1' denotes an average diameter of openings of the first resin in which the second resin is embedded and R1 denotes an average diameter of the exposed regions. Specifically, the exposed region of each fine resin particle is flattened in the direction perpendicular to the height of the fine resin particle (the tangential direction of the toner particle; or the direction perpendicular to the radial direction of the toner particle). In conventional toner particles, an average of the opening diameters of the first resin: R1' and an average of the diameters of the exposed regions (or exposed diameters): R1 satisfy the expression R1≤R1' and the exposed regions (hereinafter may be referred to as "protrusions") significantly protrude. In the toner particles of the present invention, the exposed regions are pressed or extended laterally (in the direction perpendicular to the height). Therefore, the toner particles of the present invention are clearly different from the conventional toner particles. Toner particles having such protrusions can achieve high-quality image formation.

This effect may be obtained for the following reason.

The structure where part of each fine resin particle is embedded in the core particle and the exposed region of the fine resin particle satisfies the expression R1>R1' (flat shape) can prevent both deformation of the exposed region by indentation force applied to the core particle and exfoliation of the fine resin particle by shearing force.

An external force must be applied, in order to effectively deform the exposed regions so as to satisfy the expression R1>R1' (flat shape). Upon application of the external force, preferably, the fine resin particles are firmly attached to the core particle. That is, it is necessary that the fine resin particles are not exfoliated by shearing force and only the exposed regions are pressed by indentation force.

Figure 1A:
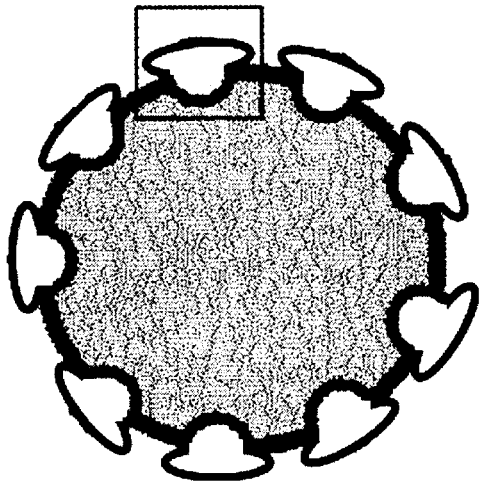
FIG. 1A is a schematic cross-sectional view of a toner particle of the present invention which is for explaining exposed regions of fine resin particles made of a second resin in the toner particle.
Figure 1B:
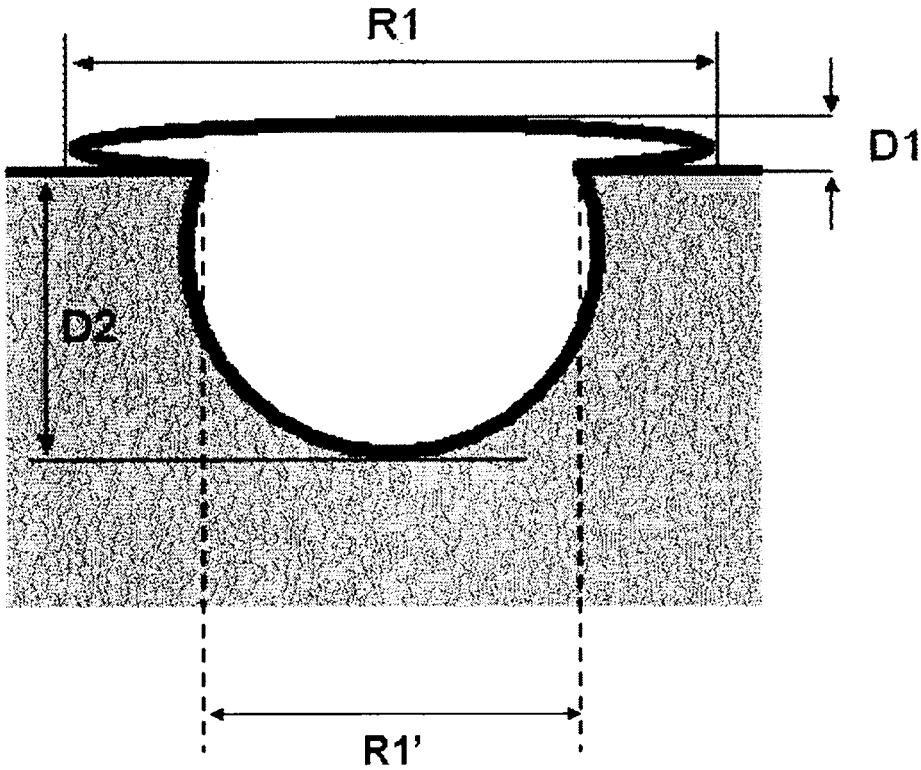
FIG. 1B is an enlarged view of FIG. 1A which is for explaining the embedded region and the exposed region of the second resin.

FIG. 1A is a schematic cross-sectional view of a toner particle of the present invention which is for explaining the exposed regions of the fine resin particles made of a second resin in the toner particle. FIG. 1B is an enlarged view of FIG. 1A which is for explaining the embedded region and the exposed region of the second resin.

As illustrated in FIG. 1B, the toner particle satisfies the expression R1>R1'. The ratio (R1/R1') of R1 to R1' is more than 1, preferably 1.1 or more, more preferably 1.2 or more. The ratio (R1/R1') of less than 1.1 is not preferred since the fine resin particles may be exfoliated during use to cause contamination.

Also, as illustrated in FIG. 1B, the toner particle preferably satisfies the expression D2/D1≥1 where D1 denotes an average height of the exposed regions of the second resin and D2 denotes an average depth of the embedded regions. In addition, the toner particle preferably satisfies the expression 3 R1/D1 where D1 denotes an average height of the exposed regions of the second resin and R1 denotes an average diameter of the exposed regions.

The embedment rate of the fine resin particles made of the second resin is not particularly limited and may be appropriately selected depending on the intended purpose, but is preferably 50% to 80%, more preferably 70% to 80%. When the average embedment rate is less than 50%, the protrusions may be exfoliated during use to cause contamination. Whereas when the average embedment rate exceeds 80%, the surface modification effect of the toner may be low. Notably, the above embedment rate can be calculated from the following formula.

$$\text{Average embedment rate (\%)} = D2/(D1+D2)\times 100$$

The toner of the present invention may be obtained by adding external additives to colored particles (herein, also called toner base particles, toner core particles, or colored resin particles) containing the core particles and protrusions on the surfaces of the core particles for improving flowability, develop ability and chargeability.

The core particles contain, as essential ingredients, a binder resin and a colorant; and, if necessary, further contain a releasing agent, a charge controlling agent and/or a plastisizer.

The first resin is used as a binder of the core particles. Then, the protrusions formed of the second resin are formed in the surfaces of the core particles, to thereby improve cleanability and heat resistance storage stability while maintaining satisfactory low-temperature fixing property of the toner. Also, the embedment rates of the fine resin particles is adjusted to fall within the specific range, to thereby improve chargeability, developing durability, adhesion resistance, cleanability and heat resistance storage stability and form high-quality images, while maintaining satisfactory low-temperature fixing property.

In the toner of the present invention, the protrusions of the second resin embedded on the surfaces of the core particles of the first resin can be formed by embedding the fine resin particles of the second resin in the surfaces of the core particles.

<Fine Resin Particles>

The fine resin particles made of the second resin can be the fine resin particles dispersed in the aqueous medium before use. The resin of the fine resin particles includes vinyl resins, polyesters, polyurethanes, polyureas and epoxy resins. Of these, vinyl resins are preferred from the viewpoint of easily obtaining the fine resin particles dispersed in the aqueous medium. Examples of the method for preparing aqueous dispersoids of vinyl fine resin particles include known polymerization methods such as an emulsification aggregation method, a suspension polymerization method and a dispersion polymerization method. Of these, an emulsification aggregation method is particularly preferred from the viewpoint of easily obtaining particles having a particle diameter suitable for the present invention.

<<Vinyl Fine Resin Particles>>

The vinyl fine resin particles used in the present invention contain a vinyl resin obtained through polymerization of a monomer mixture containing at least a styrene monomer.

In order for the colored resin particles obtained in the present invention to be used as charged functional particles like latent electrostatic image developing toner particles, the colored resin particles each preferably have an easily chargeable surface. Therefore, in the monomer mixture, the amount of the styrene monomer, which has electron orbitals where electrons can stably travel as can be seen in aromatic ring structures is preferably 50% by mass to 100% by mass, more preferably 80% by mass to 100% by mass, particularly preferably 95% by mass to 100% by mass. When the amount of the styrene monomer is less than 50% by mass, the obtained colored resin particles are poor in chargeability, which imposes limitation on applications of the colored resin particles.

Here, the styrene monomer refers to an aromatic compound having a vinyl polymerizable functional group. The polymerizable functional group includes a vinyl group, an isopropenyl group, an allyl group, an acryloyl group and a methacryloyl group.

Specific examples of the styrene monomer include styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof; 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates. Of these, preferably, styrene is mainly used since it is easily available, and has excellent reactivity and high chargeability.

Also, in the monomer mixture, the amount of an acid monomer used in the vinyl resin of the present invention is preferably 0% by mass to 7% by mass, more preferably 0% by mass to 4% by mass, particularly preferably 0% by mass; i.e., no acid monomer is contained. When the amount thereof exceeds 7% by mass, the obtained vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they tend to be exfoliated through the process of solvent removal, washing, drying and treating with external additives. Whereas when the amount thereof is 4% by mass or less, the obtained colored resin particles less changes in chargeability depending on the working environment.

Here, the acid monomer refers to a compound having an acid group in addition to the vinyl polymerizable functional group. The acid group includes carboxylic acid, sulfonic acid and phosphoric acid.

The acid monomer includes carboxyl group-containing vinyl monomers and salts thereof (e.g., (methacrylic acid, maleic acid or maleic anhydride, monoalkyl maleates, fumaric acid, monoalkyl fumarates, crotonic acid, itaconic acid, monoalkyl itaconate, glycol itaconate monoethers, citraconic acid, monoalkyl citraconates and cinnamic acid), sulfonic acid group-containing vinyl monomers and salts thereof, vinyl-based sulfuric acid monoesters and salts thereof, and phosphoric acid group-containing vinyl monomers and salts thereof. Of these, preferred are (meth)acrylic acid, maleic acid or maleic anhydride, monoalkyl maleates, fumaric acid and monoalkyl fumarates.

Also, a monomer having an ethylene oxide (EO) chain may be used for controlling compatibility to the colored particles. Non-limitative examples thereof include methoxy polyethylene glycol methacrylates and methoxy polyethylene glycol acrylates such as methoxy nonadiethylene glycol methacrylate, methoxy octadecadiethylene glycol methacrylate, methoxy tricosadiethylene glycol methacrylate; and phenoxy polyethylene glycol methacrylates and phenoxy polyethylene glycol acrylates such as phenoxy nonadiethylene glycol acrylate, phenoxy octacosadiethylene glycol acrylate and phenoxy tetracontadiethylene glycol methacrylate.

These monomers are obtained through esterification between polyethylene glycols and vinyl monomers having carboxylic acid.

These monomers can be commercially available products.

The amount of the EO chain-containing monomer used is preferably 30% by mass or less, more preferably 25% by mass or less, particularly preferably 20% by mass or less, relative to the total amount of the monomers. When the amount thereof exceeds 30% by mass, an increased number of polar groups on the toner surface considerably degrade charge stability to the environment, which is not preferred. In addition, the compatibility to the colored particles becomes too high, resulting in that the embedment rates of the fine resin particles tend to be unfavorably increased. When the amount thereof is adjusted to 20% by mass or less, the average embedment rate of the fine resin particles is maintained 80% or lower.

Also, a monomer having an ester bond (e.g., 2-acryloyloxyethyl succinate or 2-methacryloyloxyethyl phthalate) may simultaneously be used for controlling compatibility of the colored particles. In this case, the amount of such a monomer used is 10% by mass or less, preferably 5% by mass or less, more preferably 2% by mass or less, relative to the total amount of the monomers. When the amount thereof is 10% by mass or more, an increased number of polar groups on the toner surface considerably degrade charge stability to the environment, which is not preferred. In addition, the compatibility to the colored particles becomes too high, resulting in that the embedment rates of the fine resin particles tend to be unfavorably increased. When the amount thereof is adjusted to 10% by mass or less, the average embedment rate of the fine resin particles is maintained 80% or lower.

The method for obtaining the vinyl fine resin particles is not particularly limited, and exemplified by the following methods (a) to (f):

(a) a method in which a monomer mixture is allowed to undergone polymerization reaction with a suspension polymerization method, an emulsification polymerization method, a seed polymerization method or a dispersion polymerization method, to thereby produce a dispersion liquid of vinyl fine resin particles;

(b) a method in which a monomer mixture is allowed to undergone polymerization, and the obtained resin is then pulverized using a fine pulverizer of, for example, mechanically rotating type or jetting type, followed by classifying, to thereby produce fine resin particles;

(c) a method in which a monomer mixture is allowed to undergone polymerization, and the obtained resin is then dissolved in a solvent, followed by spraying of the resultant resin solution, to thereby produce fine resin particles;

(d) a method in which a monomer mixture is allowed to undergone polymerization, the obtained resin is dissolved in a solvent, another solvent is added to the resultant resin solution to precipitate fine resin particles, and then the solvent is removed to obtain fine resin particles; or a method in which a monomer mixture is allowed to undergone polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergone polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergone polymerization, the obtained resin is dissolved in a solvent, an appropriate emulsifying agent is dissolved in the resultant resin solution, followed by phase-transfer emulsification with the addition of water.

Of these, method (a) is preferably employed, since vinyl fine resin particles can be easily produced as a dispersion liquid, which is easy to use for the next step.

In the polymerization reaction of method (a), preferably, (i) a dispersion stabilizer is added to the aqueous medium, (ii) the monomer mixture to be allowed to undergone polymerization reaction is made to contain a monomer capable of imparting dispersion stability to the fine resin particles obtained through polymerization (i.e., a reactive emulsifier) or the above (i) and (ii) are performed in combination, to thereby impart dispersion stability to the obtained vinyl fine resin particles. When neither the dispersion stabilizer nor the reactive emulsifier is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the below-described fine resin particle-attaching step whereby the core particles easily aggregate or combined together resulting in that the finally obtained colored resin particles is degraded in evenness of, for example, particle diameter, shape, and surface, which is not preferred.

The dispersion stabilizer includes surfactants and inorganic dispersing agents. Examples of the surfactant include anionic surfactants such as alkylbenzenesulfonic acid salts, α-olefinsulfonic acid salts and phosphoric acid esters; cationic surfactants such as amines (e.g., alkylamine salts, aminoalcohol fatty acid derivatives, polyamine fatty acid derivatives and imidazoline) and quaternary ammonium salts (e.g., alkyltrimethyl ammonium salts, dialkyldimethyl ammonium salts, alkyldimethylbenzyl ammonium salts, pyridinium salts, alkylisoquinolinium salts and benzethonium chloride); nonionic surfactants such as fatty acid amide derivatives and polyalcohol derivatives; and amphoteric surfactants such as alanine, dodecydi(aminoethyl)glycine, di(octylaminoethyl) glycine and N-alkyl-N,N-dimethylammonium betaine. Examples of the inorganic dispersing agent include tricalcium phosphate, calcium carbonate, titanium oxide, colloidal silica and hydroxyapatite.

The weight average molecular weight of the vinyl resin is not particularly limited and may be appropriately selected depending on the intended purpose. The weight average molecular weight thereof is preferably 3,000 to 300,000, more preferably 4,000 to 100,000, particularly preferably 5,000 to 50,000. When the weight average molecular weight is lower than 3,000, the vinyl resin has low mechanical strength (i.e., is brittle). Thus, the surfaces of the finally obtained colored resin particles easily change depending on the working environment of some applications. For example, the colored resin particles considerably changes in chargeability and/or causes contamination such as attachment onto the surrounding members, which leads to degradation of image quality. Whereas when the weight average molecular weight is higher than 300,000, the number of ends of the molecules is decreased, so that the molecular chains interact with the core particles to a less extent to degrade adhesion to the core particles, which is not preferred.

The glass transition temperature (Tg) of the vinyl resin is not particularly limited and may be appropriately selected depending on the intended purpose. It is preferably 45° C. to 100° C., more preferably 55° C. to 90° C., particularly preferably 65° C. to 80° C. When the Tg is lower than 45° C., the finally obtained toner may be degraded in storage stability, for example, may involve blocking during storage at high temperatures. Whereas when the Tg exceeds 100° C., the low-temperature fixing property is degraded. Needless to say, both cases are not preferred.

<Core Particles>

A toner of the present invention is obtained through the process including a step at which at least the colorant and a binder resin made of the first resin are dissolved or dispersed in an organic solvent, and then the resultant solution or dispersion mixture is dispersed in an aqueous medium to granulate core particles; and a step at which fine resin particles of a second resin are embedded in the surface of the core particles.

<<First Resin>>

The binder resin made of the first resin added to the organic solvent is a resin at least part of which is dissolved in the organic solvent. An acid value of the resin is not particularly limited and may be appropriately selected depending on the intended purpose, but preferably 2 mgKOH/g to 24 mgKOH/g. When the acid value exceeds 24 mgKOH/g, the resin is likely to transfer to the aqueous phase, resulting in loss of the resin through the production process or easily degrading the dispersion stability of oil droplets. Also, the toner comes to absorb a larger amount of water, leading to degradation of chargeability and storageability under high-temperature, high-humidity environment. Whereas when the acid value is lower than 2 mgKOH/g, the polarity of the resin becomes low, making it difficult to uniformly disperse the colorant with some polarity in the oil droplets.

The type of the resin is not particularly limited, however, when the colored resin particles are used as a latent electrostatic image developing toner in electrophotography, the first resin is preferably a resin having a polyester skeleton from the viewpoint of obtaining good fixing property. The resin having a polyester skeleton includes polyester resins and block copolymers of polyesters and resins having other skeletons. Of these, polyester resins are preferably used since the obtained colored resin particles have high uniformity.

Examples of the polyester resin include ring-opening polymers of lactones, polycondensates of hydroxycarboxylic acid, and polycondensates of polyols and polycarboxylic acids. Of these, polycondensates of polyols and polycarboxylic acids are preferred since a wide variety of polyesters can be formed.

The peak molecular weight of the polyester resin is generally 1,000 to 30,000, preferably 1,500 to 10,000, more preferably 2,000 to 8,000. When the peak molecular weight is lower than 1,000, the heat resistance storage stability of the toner is degraded. Whereas when the peak molecular weight exceeds 30,000, the low-temperature fixing property of the toner as latent electrostatic image developing toner is degraded.

Also, the glass transition temperature of the polyester resin is not particularly limited and may be appropriately selected depending on the intended purpose. It is preferably 45° C. to 70° C., more preferably 50° C. to 65° C. Presumably, the toner or toner cartridge is transported under high-temperature, high-humidity environment of 40° C. and 90%. Thus, when the glass transition temperature is lower than 45° C., the obtained colored resin particles are deformed under application of a certain pressure or stick to each other. As a result, there is a possibility that the toner particles cannot behave as particles. When the glass transition temperature is higher than 70° C., the formed toner is degraded in low-temperature fixing property when the colored resin particles are used as a latent electrostatic image developing toner. Needless to say, both cases are not preferred.

—Polyol—

Examples of polyols (1) include diols (1-1) and trihydric or higher polyols (1-2), with (1-1) alone or a mixture containing (1-1) and a small amount of (1-2) being preferred.

Examples of diols (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; and adducts of the above-listed bisphenols with alkylene oxides (e.g., ethylene oxide, propylene oxide and butylene oxide).

Of these, preferred are C2 to C12 alkylene glycols and alkylene oxide adducts of bisphenols. Particularly preferred are combinations of alkylene oxide adducts of bisphenols and C2 to C12 alkylene glycols.

Examples of the trihydric or higher polyols (1-2) include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

—Polycarboxylic Acid—

Examples of polycarboxylic acids (2) include dicarboxylic acids (2-1) and trivalent or higher polycarboxylic acids (2-2), with (2-1) alone or a mixture containing (2-1) and a small amount of (2-2) being preferred.

Examples of dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid and hexafluoroisopropylidenediphthalic anhydride. Of these, preferred are C4 to C20 alkenylenedicarboxylic acids and C8 to C20 aromatic dicarboxylic acids.

Examples of trivalent or higher polycarboxylic acids (2-2) include C9 to C20 aromatic polycarboxylic acids (e.g., trimellitic acid and pyromellitic acid). Notably, polycarboxylic acids (2) reacted with polyols (1) may be acid anhydrides or lower alkyl esters (e.g., methyl ester, ethyl ester and isopropyl ester) of the above carboxylic acids.

The ratio between polyol and polycarboxylic acid is not particularly limited and may be appropriately selected depending on the intended purpose. The ratio therebetween is generally 2/1 to 1/2, preferably 1.5/1 to 1/1.5, more preferably 1.3/1 to 1/1.3, in terms of the equivalent ratio [OH]/[COOH] of the hydroxyl group [OH] to the carboxyl group [COOH].

—Modified Resin—

In order for the colored resin particles to have an increased mechanical strength and, when the colored resin particles are used as a latent electrostatic image developing toner, further involve no hot offset upon fixing, a modified resin containing an end isocyanate group may be dissolved in the oil phase for producing the colored resin particles. The method for producing the modified resin includes a method in which an isocyanate group-containing monomer is used for polymerization reaction to obtain an isocyanate group-containing resin; and a method in which a resin having an active hydrogen-containing group at its end is obtained through polymerization and then reacted with polyisocyanate to obtain a polymer containing an isocyanate group at its end. The latter method is preferred from the viewpoint of satisfactorily introducing an isocyanate group into the end of the polymer. Examples of the active hydrogen-containing group include a hydroxyl group (i.e., an alcoholic hydroxyl group and a phenolic hydroxyl group), an amino group, a carboxyl group and a mercapto group, with an alcoholic hydroxyl group being preferred. Considering uniformity of particles, the skeleton of the modified resin is preferably the same as that of a resin dissolvable in the organic solvent. The resin preferably has a polyester skeleton. In one employable method for producing a polyester having an alcoholic hydroxyl group at its end, polycondensation reaction is performed between a polyol having more functional groups (i.e., hydroxyl groups) and a polycarboxylic acid having less functional groups (i.e., carboxyl groups).

—Amine Compound—

In the process of dispersing the oil phase in the aqueous phase to form particles, some isocyanate groups of the modified resin are hydrolyzed into amino groups, which are then reacted with unreacted isocyanate groups to allow elongation reaction to proceed. Also, an amine compound may be used in combination to perform elongation reaction and introduce crosslinked points as well as the above reaction. The amine compound (B) includes diamines (B1), trivalent or higher polyamines (B2), aminoalcohols (B3), aminomercaptans (B4), amino acids (B5) and amino-blocked compounds (B6) obtained by blocking the amino group of B1 to B5.

The diamine (B1) includes aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine). The trivalent or higher polyamine (B2) includes diethylenetriamine and triethylenetetramine.

The aminoalcohol (B3) includes ethanolamine and hydroxyethylaniline. The aminomercaptan (B4) includes aminoethylmercaptan and aminopropylmercaptan. The amino acid (B5) includes aminopropionic acid and aminocaproic acid.

The amino-blocked compound (B6) obtained by blocking the amino group of B1 to B5 includes oxazolidine compounds and ketimine compounds derived from the amines B1 to B5 and ketones (e.g., acetone, methyl ethyl ketone and methyl isobutyl ketone). Among these amines (B), preferred are B1 and a mixture containing B1 and a small amount of B2.

Regarding the amount of the amine (B) relative to the amount of the isocyanate group-containing prepolymer (A), the number of amino groups [NHx] in the amine (B) is four or less times, preferably twice or less, more preferably 1.5 or less times, further preferably 1.2 or less times, the number of isocyanate groups [NCO] in the isocyanate group-containing prepolymer (A). When the number of amino groups [NHx] in the amine (B) is preferably more than four times the number of isocyanate groups [NCO] in the isocyanate group-containing prepolymer (A), excessive amino groups disadvantageously block isocyanate groups to prevent the elongation reaction of the modified resin. As a result, the polyester is decreased in molecular weight, resulting in degradation of hot offset resistance of the toner.

—Organic Solvent—

The organic solvent is preferably a volatile organic solvent having a boiling point lower than 100° C. from the viewpoint of easily removing the solvent. The organic solvent includes toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. When the resin to be dissolved or dispersed in the organic solvent has a polyester skeleton, preferably used are ester solvents (e.g., methyl acetate, ethyl acetate and butyl acetate) or ketone solvents (e.g., methyl ethyl ketone and methyl isobutyl ketone) since these solvents have high dissolution capability to the resin. Among them, methyl acetate, ethyl acetate and methyl ethyl ketone are particularly preferred since these can be removed more easily.

—Aqueous Medium—

The aqueous medium may be water alone or a mixture of water and a water-miscible solvent. The water-miscible solvent includes alcohols (e.g., methanol, isopropanol and ethylene glycol), dimethylformamide, tetrahydrofuran, cellosolves (e.g., methyl cellosolve (registered trademark)) and lower ketones (e.g., acetone and methyl ethyl ketone).

—Surfactant—

A surfactant is used for dispersing the oil phase in the aqueous medium to form liquid droplets. The amount of the surfactant contained in the aqueous medium is 7% or less, preferably 5% or less, more preferably 3% or less, since the surfactant greatly influences the embedment rates of the fine resin particles. When the amount thereof is more than 7%, the wettability of the toner becomes too high to make it difficult to form fine resin particles, which is not preferred. By adjusting the surfactant to 7% or less, it becomes possible for the embedment rates of the fine resin particles to be 40% or higher.

The surfactant includes anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine. Also, a fluoroalkyl group-containing surfactant can exhibit its dispersing effects even in a very small amount.

A fluoroalkyl group-containing anionic surfactant suitably used includes fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates. The cationic surfactant includes aliphatic primary, secondary or tertiary amine acid containing a fluoroalkyl group, aliphatic quaternary ammonium salts (e.g., perfluoroalkyl (C6 to C10) sulfonamide propyltrimethylammonium salts), benzalkonium salts, benzethonium chloride, pyridinium salts and imidazolinium salts.

—Inorganic Dispersing Agent—

The dissolution or dispersion product of the toner composition may be dispersed in the aqueous medium in the presence of an inorganic dispersing agent or fine resin particles. The inorganic dispersing agent includes tricalcium phosphate, calcium carbonate, titanium oxide, colloidal silica and hydroxyapatite. Use of the dispersing agent is preferred since a sharp particle size distribution and a stable dispersion state can be attained.

—Protective Colloid—

Further, a polymeric protective colloid may be used to stabilize dispersed liquid droplets.

For example, acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, p-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds thereof; acid chlorides (e.g., acrylic acid chloride and methacrylic acid chloride); homopolymers or copolymers of nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose) can be used.

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles (toner particles). Also, the calcium phosphate may be removed through enzymatic decomposition. Alternatively, the dispersing agent used may remain on the surfaces of the toner particles. But, the dispersing agent is preferably removed through washing after elongation and/or crosslinking reaction in terms of chargeability of the formed toner.

<<Colorant>>

Known dyes and pigments can be used as the colorant. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof.

—Colorant Formed into Masterbatch—

In the present invention, the colorant may be mixed with a resin to form a masterbatch.

Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

—Preparation Method of Masterbatch—

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

Other possible components now will be described.

<Releasing Agent>

In order for the toner to have an increased releasing property during fixing when the colored resin particles are used as a latent electrostatic image developing toner, a releasing agent may be dispersed in the organic solvent in advance.

The releasing agent may be, for example, wax and silicone oil that exhibit a sufficiently low viscosity when heated during the fixing process and that are difficult to be compatible or swelled with other colored resin particles materials on the fixing member surface. Considering the storage stability of the colored resin particles themselves, preferably used is wax that generally exists as a solid in the colored resin particles during storage.

The wax includes long-chain hydrocarbons and carbonyl group-containing waxes.

Examples of the long-chain hydrocarbon include polyolefin waxes (e.g., polyethylene wax and polypropylene wax); petroleum waxes (e.g., paraffin waxes, SASOL wax and microcrystalline waxes); and Fischer-Tropsch waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Of these, long-chain hydrocarbons are preferred since they exhibit better releasing property. Furthermore, the long-chain hydrocarbons may be used in combination with the carbonyl group-containing waxes. The amount of the releasing agent contained in the toner is not particularly limited and may be appropriately selected depending on the intended purpose. It is preferably 2% by mass to 25% by mass, more preferably 3% by mass to 20% by mass, particularly preferably 4% by mass to 15% by mass. When it is less than 2% by mass, the releasing property of the formed toner cannot be obtained during fixing. Whereas when it is more than 25% by mass, the formed colored resin particles is degraded in mechanical strength.

<Charge Controlling Agent>

If necessary, a charge controlling agent may be dissolved or dispersed in the organic solvent in advance.

The charge controlling agent may be any known charge controlling agent. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, a functional group such as a sulfonic acid group, carboxyl group, or quaternary ammonium salt. The any amount of the charge controlling agent contained in the toner may be used so long as the charge controlling agent can exhibit its performances without degrading the fixing property of the toner. The amount thereof is 0.5% by mass to 5% by mass, preferably 0.8% by mass to 3% by mass.

<Production Method>

The production method of the core particles may be a known toner particle production method. In particular, there can be employed an emulsification aggregation method, a dissolution suspension method and a suspension polymerization method, each of which uses an aqueous medium.

After the core particles have been produced by a known emulsification aggregation method or suspension polymerization method, fine resin particles are added to the reaction system, so that the fine resin particles are attached to and fused with the surfaces of the core particles. Here, the reaction system may be heated to promote attachment and fusion of the fine resin particles. Also, use of a metal salt is effective in promoting the attachment and fusion.

<<Preparation Step of Oil Phase>>

The oil phase, which contains an organic solvent, and materials such as a resin and a colorant dissolved or dispersed in the organic solvent, may be prepared in the following manner. Specifically, the materials such as the resin and the colorant are gradually added to the organic solvent under stirring so that these materials are dissolved or dispersed therein. Notably, when a pigment is used as the colorant and/or when materials such as the releasing agent and the charge controlling agent used are poorly dissolvable to the organic solvent, the particles of these materials are preferably micronized before the addition to the organic solvent.

As described above, the colorant may be formed into a masterbatch. Similarly, the materials such as the releasing agent and the charge controlling agent may be formed into a masterbatch.

In another means, the colorant, the releasing agent and the charge controlling agent may be dispersed through a wet process in the organic solvent, if necessary in the presence of a dispersion aid, to thereby obtain a wet master.

In still another means, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant, releasing agent and charge controlling agent, dispersed with any of the above means, have been dissolved or dispersed in the organic solvent together with a resin, the resultant mixture may be further dispersed. The dispersion may be performed using a known disperser such as a bead mill or a disc mill.

<<Preparation Step of Toner Core Particles>>

No particular limitation is imposed on the method for preparing a dispersion liquid containing toner core particles formed of the oil phase by dispersing the oil phase obtained at the above-described step in the aqueous medium containing at least the surfactant. This method may use a known disperser such as a low-speed shearing disperser, a high-speed shearing disperser, a friction disperser, a high-pressure jet disperser or an ultrasonic disperser. Among them, a high-speed shearing disperser is preferably used to form dispersoids having a particle diameter of 2 μm to 20 μm. The rotation speed of the high-speed shearing disperser is not particularly limited but is generally 1,000 rpm to 30,000 rpm, preferably 5,000 rpm to 20,000 rpm. The dispersion time is not particularly limited but is generally 0.1 min to 5 min in a batch method. When the dispersion time exceeds 5 min, unfavorable small particles remain and excessive dispersion is performed to make the dispersion system unstable, potentially forming aggregates and coarse particles, which is not preferred. The dispersion temperature is generally 0° C. to 40° C., preferably 10° C. to 30° C. When the dispersion temperature exceeds 40° C., molecular movements are excited to degrade dispersion stability, easily forming aggregates and coarse particles, which is not preferred. Whereas when the dispersion temperature is lower than 0° C., the dispersion liquid is increased in viscosity to require elevated energy for dispersion, leading to a drop in production efficiency. The surfactant usable may be the same as those mentioned in the above-described production method of the fine resin particles. In order to efficiently disperse the oil droplets containing the solvent, the surfactant used is preferably a disulfonic acid salt having a relatively high HLB. The concentration of the surfactant in the aqueous medium is 1% by mass to 10% by mass, more preferably 2% by mass to 8% by mass, more preferably 3% by mass to 7% by mass. When the concentration thereof exceeds 10% by mass, each oil droplet becomes too small and also has a reverse micellar structure. Thus, the dispersion stability is degraded due to the surfactant added in such an amount, to thereby easily form coarse oil droplets. Whereas when the concentration thereof is lower than 1% by mass, the oil droplets cannot be stably dispersed to form coarse oil droplets. Needless to say, both cases are not preferred.

<<Fine Resin Particle-Attaching Step>>

The dissolution suspension method may be performed as described above. However, the following method is preferably employed since the fine resin particles are attached onto or fused with the colored particles more firmly. Specifically, the method includes dissolving or dispersing materials of the colored particles in an organic solvent to prepare an oil phase, dispersing the oil phase in an aqueous medium, and adding fine resin particles so as to be attached onto and fused with the surfaces of liquid droplets of the oil phase. Addition of the fine resin particles at the production step of toner core particles forms large, ununiform fine resin particles, which is not preferred.

Next, description will be given to the fine resin particle-attaching step, taking as an example the case where vinyl fine resin particles are used as the fine resin particles.

The obtained colored particle dispersion liquid contains stable liquid droplets of the core particles, so long as the dispersion liquid is being stirred. For attaching the fine resin particles onto the colored particles, the fine resin particle dispersion liquid is added to this core particle slurry where the liquid droplets of the oil phase are dispersed in the aqueous phase. The vinyl fine resin particle dispersion liquid is added thereto for 30 sec or longer. When it is added for 30 sec or shorter, the dispersion system drastically changes to form aggregated particles. In addition, the vinyl fine resin particles are ununiformly attached onto the core particles, which is not preferred. Meanwhile, adding the vinyl fine resin particle dispersion liquid over an unnecessarily long period of time (e.g., 60 min or longer) is not preferred from the viewpoint of lowering production efficiency.

Thus, the period for which the vinyl fine resin particle dispersion liquid is added is preferably 30 sec to 60 min, more preferably 1 min to 10 min, particularly preferably 1 min to 5 min.

Before added to the core particle dispersion liquid, the vinyl fine resin particle dispersion liquid may be appropriately diluted or concentrated so as to have a desired concentration. The concentration of the vinyl fine resin particle dispersion liquid is preferably 5% by mass to 30% by mass, more preferably 8% by mass to 20% by mass. When the concentration is less than 5% by mass, the concentration of the organic solvent greatly changes upon addition of the dispersion liquid to lead to insufficient attachment of the fine resin particles, which is not preferred. Also, when the concentration exceeds 30% by mass, the fine resin particles tend to be localized in the core particle dispersion liquid, resulting in that the fine resin particles are ununiformly attached onto the core particles, which is not preferred.

Also, for the production of liquid droplets of the oil phase, the amount of the surfactant contained in the aqueous phase is 7% by mass or less, preferably 6% by mass or less, more preferably 5% by mass or less. When the amount of the surfactant exceeds 7% by mass, the embedment rates of the fine resin particles considerably decrease, which is not preferred.

The following may explain the reason why the vinyl fine resin particles are sufficiently firmly attached onto the core particles by the method of the present invention. Specifically, when the vinyl fine resin particles are attached onto the liquid droplets of the core particles, the core particles can freely deform to sufficiently form contact surfaces with the vinyl fine resin particles and the vinyl fine resin particles are swelled with or dissolved in the organic solvent to make it easier for the vinyl fine resin particles to adhere to the resin in the core particles. Therefore, in this state, the organic solvent must exist in the system in a sufficiently large amount. Specifically, in the core particle dispersion liquid, the amount of the organic solvent is 50% by mass to 150% by mass, preferably 70% by mass to 125% by mass, relative to the amount of the solid matter (e.g., resin, colorant, if necessary, releasing agent and charge controlling agent). When the amount of the organic solvent exceeds 150% by mass, the amount of the colored resin particles obtained through one production process is reduced, resulting in low production efficiency. Also, a large amount of the organic solvent impairs dispersion stability, making it difficult to attain stable production, which is not preferred.

The temperature at which the vinyl fine resin particles are made to attach onto the core particles is 10° C. to 60° C., preferably 20° C. to 45° C. When it exceeds 60° C., required energy for production is elevated to increase environmental loading, and the presence of vinyl fine resin particles having a low acid value on the surfaces of liquid droplets makes the dispersion system to be unstable to thereby potentially form coarse particles. Meanwhile, when the temperature is less than 10° C., the dispersion liquid is increased in viscosity, leading to an insufficiently attachment of the fine resin particles. Needless to say, both cases are not preferred.

The rate of the fine resin particles relative to the total mass of the toner is 1% to 20%, preferably 3% to 15%, more preferably 5% to 10%. When the rate thereof is 1% or less, satisfactory effects cannot be obtained. Whereas when the rate thereof is 20% or more, excessive fine resin particles are weakly attached onto the toner core particles, causing filming or other unfavorable phenomena.

<<Desolvation Step>>

In one employable means for removing the organic solvent from the obtained colored resin dispersion liquid, the entire system is gradually increased in temperature with stirring, to thereby completely evaporate off the organic solvent contained in the liquid droplets.

In another employable means, the obtained colored resin dispersion liquid with stirring is sprayed toward a dry atmosphere, to thereby completely evaporate off the organic solvent contained in the liquid droplets. In still another employable means, the colored resin dispersion liquid is reduced in pressure with stirring to evaporate off the organic solvent. The latter two means may be used in combination with the first means.

The dry atmosphere toward which the emulsified dispersion liquid is sprayed generally uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product has satisfactory quality.

<<Aging Step>>

When a modified resin having an end isocyanate group is added, an aging step may be performed to allow elongation/crosslinking reaction of the isocyanate to proceed. The aging time is generally 10 min to 40 hours, preferably 2 hours to 24 hours. The aging temperature is generally 0° C. to 65° C., preferably 35° C. to 50° C.

<<Washing Step>>

The dispersion liquid of the colored resin particles obtained in the above-described manner contains not only the colored resin particles but also such subsidiary materials as the surfactant and dispersing agent. Thus, the dispersion liquid is washed to separate the colored resin particles from the subsidiary materials. Examples of the washing method of the colored resin particles include a centrifugation method, a reduced-pressure filtration method and a filter press method, but employable washing methods in the present invention are not limited thereto. Any of the above methods forms a cake of the colored resin particles. If the colored resin particles are not sufficiently washed through only one washing process, the formed cake may be dispersed again in an aqueous solvent to form a slurry, which is repeatedly treated with any of the above methods to taken out the colored resin particles. When a reduced-pressure filtration method or a filter press method is employed for washing, an aqueous solvent may be made to penetrate the cake to wash out the subsidiary materials contained in the colored resin particles. The aqueous solvent used for washing is water or a solvent mixture of water and an alcohol such as methanol or ethanol. Use of water is preferred from the viewpoint of reducing cost and environmental load caused by, for example, drainage treatment.

<<Drying Step>>

The washed colored resin particles containing the aqueous medium in a large amount are dried to remove the aqueous medium, whereby only colored resin particles can be obtained. The drying method uses, for example, a spray dryer, a vacuum freezing dryer, a reduced-pressure dryer, a ventilation shelf dryer, a movable shelf dryer, a fluidized-bed-type dryer, a rotary dryer or a stirring-type dryer. The colored resin particles are preferably dried until the water content is finally decreased less than 1% by mass. Also, when the dry colored resin particles flocculate to cause inconvenience in use, the flocculated particles may be separated from each other through beating using, for example, a jet mill, HENSCHEL MIXER, a super mixer, a coffee mill, an oster blender or a food processor.

<<Deformation Step of Exposed Regions>>

An external force is preferably applied in order to deform the exposed regions to be flat. A method for applying the external force is not particularly limited and may be appropriately selected depending on the intended purpose. Known mixers can be used. Examples of the mixers include a jet mill, HENSCHEL MIXER, a super mixer, a coffee mill, an oster blender or a food processor. Heat treatment is also preferably performed at the same time with mixing in order for flattening to be more effective. The heat treatment can be performed using known surface modifying devices such as METEO-RAINBOW (product of Nippon Pneumatic Mfg. Co., Ltd.)

The temperature at which the heat treatment is performed is not particularly limited and may be appropriately selected depending on the intended purpose, but is preferably 30° C. to 50° C., more preferably 40° C. to 45° C. When the temperature is less than 30° C., the deformation (surface modification) through the heat treatment cannot be sufficiently accelerated in some cases. When the temperature exceeds 50° C., the toner may be fused with the device.

The ratio D2/D1 of an average depth of the embedded regions: D2 to an average height of the exposed regions: D1 is not particularly limited and may be appropriately selected depending on the intended purpose, but is preferably 1 or more, more preferably 3 or more, particularly preferably 5 or more. When the ratio is less than 1, the adhesion force between the fine resin particles and the core particle becomes low to make the fine resin particles to be easily exfoliated, which is not preferred.

The ratio R1/D1 of an average diameter of the exposed regions: R1 (an average of longitudinal lengths) to the average height of the exposed regions: D1 is not particularly limited and may be appropriately selected depending on the intended purpose, but is preferably 3 or more, more preferably 5 or more, particularly preferably 10 or more. When the ratio is less than 3, the thickness of each exposed region is increased relative to the longitudinal length thereof, causing the fine resin particles to be exfoliated and deformed to thereby change the toner properties, which is not preferred.

The average of the coverage rates of the exposed regions on the surface of the core particle is not particularly limited and may be appropriately selected depending on the intended purpose, but is preferably 30% or more, more preferably 50% or more, particularly preferably 80% or more. When it is less than 30%, the effects obtained through the surface modification become poor, which is not preferred.

The standard deviation of the coverage rates of the exposed regions on the surface of the core particle is not particularly limited and may be appropriately selected depending on the intended purpose, but is preferably 10 or less, more preferably 7 or less, particularly preferably 5 or less. When the standard deviation exceeds 10, protrusions on the toner surface becomes ununiform, leading to background smear, low transferability, and low heat resistance storage stability, which is not preferred.

The method for producing the toner particles having protrusions on the surface thereof includes, in addition to the wet methods described above, dry methods in which the toner particle base and the fine resin particles may be mixed together under stirring so as to attain mechanical adhesion or coating of the fine resin particles on the toner particle base. However, the dry methods are not preferred for the following reasons. In the dry methods, large shear force cannot be applied. This is because the dry methods apply, in the mixing and stirring step, not only indentation force for deforming or attaching the fine resin particles to the toner core particles but also shearing force which exfoliates the fine resin particles. Therefore the fine resin particles cannot firmly be attached to the toner particle base, or the exposed regions cannot be flattened. Accordingly, exfoliation and deformation of the fine resin particles cannot be suppressed in a developing device. It is preferable that the fine resin particles firmly adhere to the core particles through the wet methods so that adhesion therebetween resists mechanical impact and the exposed regions can be flattened.

<Image Forming Method, Image Forming Apparatus, Process Cartridge>

[Image Forming Apparatus, Process Cartridge]

The image forming apparatus of the present invention forms image using the toner of the present invention. Notably, the toner of the present invention may be used as a one-component developer or a two-component developer. Preferably, the toner of the present invention is used as a one-component developer. Also, the image forming apparatus of the present invention preferably has an endless intermediate transfer unit. Further, the image forming apparatus of the present invention preferably has a cleaning unit configured to remove the toner remaining on the photoconductor and/or the intermediate transfer unit. The cleaning unit does not necessarily have to have a cleaning blade. The image forming apparatus of the present invention preferably has a fixing unit configured to fix an image with a roller or belt having a heating device. The fixing unit in the image forming apparatus of the present invention is a fixing unit having a fixing member that requires no oil application.

The image forming apparatus preferably includes other units appropriately selected depending on the intended purpose such as a charge-eliminating unit, a recycling unit, and a controlling unit.

The image forming apparatus of the present invention may be formed into a process cartridge, which is detachably mounted to the main body of the image forming apparatus, by incorporating together the photoconductor and the constituent members (e.g., the developing unit and the cleaning unit). Alternatively, the photoconductor and at least one of the charging unit, exposing unit, developing unit, transfer unit, separating unit and cleaning unit are supported together to form a process cartridge, which is a single unit detachably mounted to the main body of the image forming apparatus using a guide unit thereof (e.g., a rail).

Figure 2:
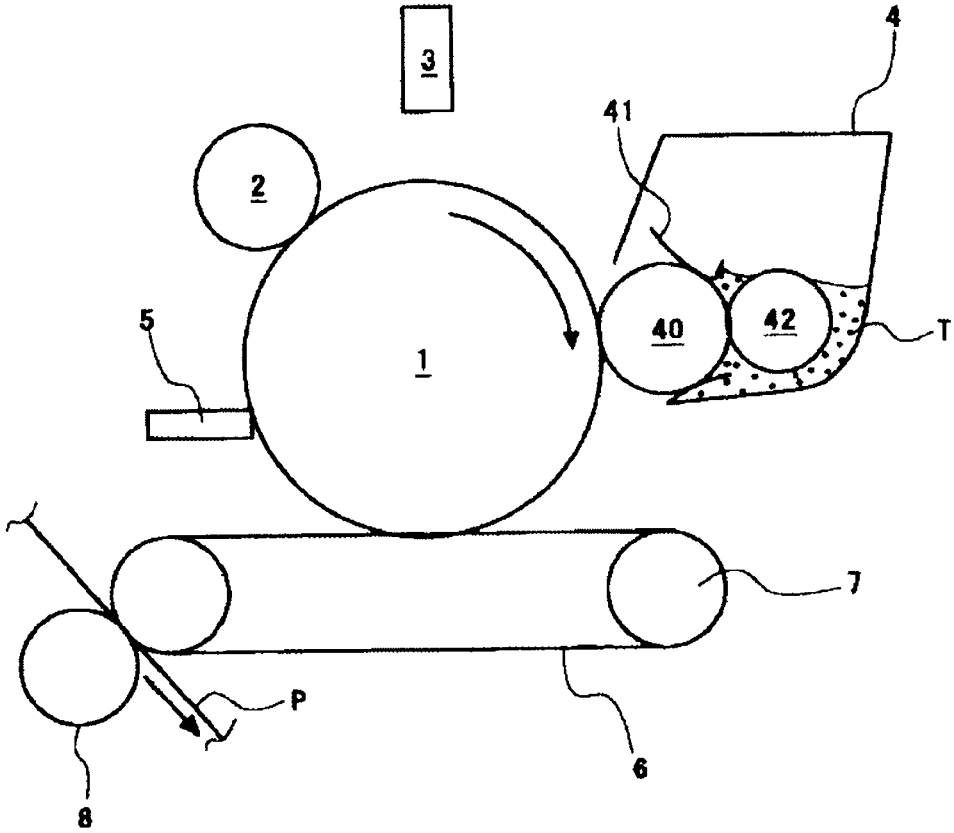
FIG. 2 illustrates one exemplary image forming apparatus of the present invention.

FIG. 2 illustrates one exemplary image forming apparatus of the present invention. This image forming apparatus contains, in an unillustrated main body casing, a latent image bearing member (1) rotated clockwise in FIG. 2 which is provided therearound with a cleaning device (2), an exposing device (3), a developing device (4) having the electrostatic image developing toner (T) of the present invention, a cleaning part (5), an intermediate transfer medium (6), a supporting roller (7), a transfer roller (8), and an unillustrated charge-eliminating unit.

This image forming apparatus has an unillustrated paper-feeding cassette containing a plurality of recording paper sheets (P), which are exemplary recording media. The recording paper sheets (P) in the paper-feeding cassette are fed one by one with an unillustrated paper-feeding roller to between the intermediate transfer medium (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 2, the latent image bearing member (1) is uniformly charged with the charging device (2). Then, the latent image bearing member (1) is irradiated with laser beams modulated by image date from the exposing device (3), to thereby form a latent electrostatic image. The latent electrostatic image formed on the latent image bearing member (1) is developed with the toner using the developing device (4). Next, the toner image formed with the developing device (4) is transferred from the latent image bearing member (1) to the intermediate transfer medium (6) through application of transfer bias. Separately, the recording paper sheet (P) is fed to between the intermediate transfer medium (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller and a press roller, wherein the fixing roller is heated to a predetermined temperature and the press roller is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating device. The image forming apparatus uniformly charges, with the charging device (2), the latent image bearing member (1) which has been charge-eliminated by the charge-eliminating device, and performs the next image formation in the same manner as described above.

Next will be described in detail the members suitably used in the image forming apparatus of the present invention.

The material, shape, structure and size of the latent image bearing member (1) are not particularly limited and may be appropriately selected from those know in the art. The latent image bearing member is suitably in the form of a drum or belt, and is, for example, an inorganic photoconductor made of, for example, amorphous silicon or selenium and an organic photoconductor made of, for example, polysilane or phthalopolymethine. Of these, an amorphous silicon photoconductor or an organic photoconductor is preferred since it has a long service life.

The latent electrostatic image can be formed on the latent image bearing member (1) with a latent electrostatic image-forming unit by, for example, imagewise exposing the charged surface of the latent image bearing member (1). The latent electrostatic image-forming unit contains at least the charging device (2) which charges the surface of the latent image bearing member (1) and the exposing device (3) which imagewise exposes the surface of the latent image bearing member (1).

The charging step can be performed by, for example, applying a voltage to the surface of the latent image bearing member (1) using the charging device (2).

The charging device (2) is not particularly limited and may be appropriately selected depending on the intended purpose. Examples thereof include contact-type chargers known per se having, for example, an electroconductive or semi-electroconductive roller, a brush, a film and a rubber blade; and non-contact-type chargers utilizing colona discharge such as corotron and scorotron.

The charging device (2) may be a charging roller as well as a magnetic brush and a fur brush. The shape thereof may be suitably selected according to the specification or configuration of an electrophotographic apparatus. When a magnetic brush is used as the charging device, the magnetic brush is composed of a charging member of various ferrite particles such as Zn—Cu ferrite, a non-magnetic electroconductive sleeve to support the ferrite particles, and a magnetic roller included in the non-magnetic electroconductive sleeve. Also, the fur brush is, for example, a fur treated to be electroconductive with, for example, carbon, copper sulfide, a metal or a metal oxide, and the fur is coiled or mounted to a metal or a metal core which is treated to be electroconductive, thereby obtaining the charging device.

The charging device (2) is not limited to the aforementioned contact-type chargers. However, the contact-type chargers are preferably used from the viewpoint of reducing the amount of ozone generated from the charger in the image forming apparatus.

The exposing can be performed by, for example, imagewise exposing the photoconductor surface with the exposing device (3). The exposing device (3) is not particularly limited and may be appropriately selected depending on the intended purpose, so long as it attains desired imagewise exposure to the surface of the latent image bearing member (1) charged with the charging device (2). Examples thereof include various exposing devices such as a copy optical exposing device, a rod lens array exposing device, a laser optical exposing device and a liquid crystal shutter exposing device.

The developing can be performed by, for example, developing the latent electrostatic image with the toner of the present invention using the developing device (4). The developing device (4) is not particularly limited, so long as it attains development using the toner of the present invention, and may be appropriately selected from known developing units. Preferred examples of the developing units include those having a developing device which has the toner of the present invention therein and which can apply the toner to the latent electrostatic image in a contact or non-contact manner.

The developing device (4) preferably has a developing roller (40) and a thin layer-forming member (41). Here, the developing roller (40) has a toner on the circumferential surface thereof and supplies the toner to the latent electrostatic image formed on the latent image bearing member (1) while being rotated together with the latent image bearing member (1) the developing roller (40) is in contact with. The thin layer-forming member (41) comes into contact with the circumferential surface of the developing roller (40) to form a thin layer of the toner on the developing roller (40).

The developing roller (40) used is preferably a metal roller or elastic roller. The metal roller is not particularly limited and may be appropriately selected depending on the intended purpose. Examples thereof include an aluminum roller. By treating the metal roller through blast treatment, the developing roller (40) having a desired surface friction coefficient can be formed relatively easily. Specifically, an aluminum roller can be treated through glass bead blasting to roughen the roller surface. The thus-obtained developing roller can attach an appropriate amount of toner thereonto.

The elastic roller used is a roller coated with an elastic rubber layer. The roller is further provided thereon with a surface coat layer made of a material that is easily chargeable at the opposite polarity to that of the toner. The hardness of the elastic rubber layer is set to be equal to or lower than 60° according to JIS-A, in order to prevent the toner from being degraded due to pressure concentration at a contact region between the elastic rubber layer and the thin layer-forming member (41). The surface roughness (Ra) of the elastic rubber layer is set to be 0.3 μm to 2.0 μm so as to retain, on its surface, the toner in a necessary amount. Also, since the developing roller (40) receives a developing bias for forming an electrical field between the developing roller (40) and the latent image bearing member (1), the resistance of the elastic rubber layer is set to be $10^3\Omega$ to $10^{10}\Omega$. The developing roller (40) is rotated counterclockwise to convey the toner retained thereon to positions where the developing roller (40) faces the thin layer forming member (41) and the latent image bearing member (1).

The thin layer-forming member (41) is provided upstream of the contact region between the supply roller (42) and the developing roller (40) in a direction in which the developing roller (40) is rotated. The thin layer-forming member (41) is a metal plate spring of stainless steel (SUS) or phosphor bronze, and its free end is brought into contact with the surface of the developing roller (40) at a press force of 10 N/m to 40 N/m. The thin layer-forming member (41) forms the toner passing thereunder into a thin layer by the press force and frictionally charges the toner. In addition, for aiding frictional charging, the thin layer forming member (41) receives a regulation bias having a value offset in the same direction of the polarity of the toner against the developing bias.

The rubber elastic material forming the surface of the developing roller (40) is not particularly limited and may be appropriately selected depending on the intended purpose. Examples thereof include styrene-butadiene copolymer rubbers, butadiene copolymer rubbers, acrylonitrile-butadiene copolymer rubbers, acrylic rubbers, epichlorohydrin rubbers, urethane rubbers, silicone rubbers and blends of two or more of them. Of these, particularly preferred are blend rubbers of epichlorohydrin rubbers and acrylonitrile-butadiene copolymer rubbers.

The developing roller (40) is produced by, for example, coating the circumference of an electroconductive shaft with the rubber elastic material. The electroconductive shaft is made, for example, of a metal such as stainless steel (SUS).

The transfer can be performed by, for example, charging the latent image bearing member (1) with a transfer roller. The transfer roller preferably has a primary transfer unit configured to transfer the toner image onto the intermediate transfer medium (6) to form a transfer image; and a secondary transfer unit (transfer roller (8)) configured to transfer the transfer image onto a recording paper sheet (P). More preferably, in response to the case where toners of two or more colors, preferably, full color toners are used, the transfer roller has a primary transfer unit configured to transfer the toner images onto the intermediate transfer medium (6) to form a composite transfer image; and a secondary transfer unit configured to transfer the composite transfer image onto a recording paper sheet (P).

Notably, the intermediate transfer medium (6) is not particularly limited and may be appropriately selected from known transfer media. Preferred examples thereof include a transfer belt.

The transfer unit (the primary transfer unit or the secondary transfer unit) preferably has at least a transfer device which charge-separates the toner image from the latent image bearing member (1) toward the recording paper sheet (P). The number of the transfer unit may be one or more. Examples of the transfer unit include a corona transfer device using colona discharge, a transfer belt, a transfer roller, a pressure transfer roller and an adhesive transfer device.

Notably, typical examples of the recording paper sheet (P) include plain paper. The recording paper sheet, however, is not particularly limited and may be appropriately selected depending on the intended purpose, so long as it can receive an unfixed image formed after development. Further examples of the recording paper sheet employable include PET bases for use in OHP.

The fixing can be performed by, for example, fixing the toner image transferred onto the recording paper sheet (P) with a fixing unit. The fixing of the toner images of colors may be performed every time when each toner image is transferred onto the recording paper sheet (P) or at one time after the toner images of colors have been mutually superposed.

The fixing unit is not particularly limited and may be appropriately selected depending on the intended purpose. The fixing unit is preferably a known heat-press unit. Examples of the heat-press unit include a combination of a heating roller and a pressing roller and a combination of a heating roller, a pressing roller and an endless belt. Notably, the heating temperature of the heat-press unit is preferably 80° C. to 200° C.

Figure 3:
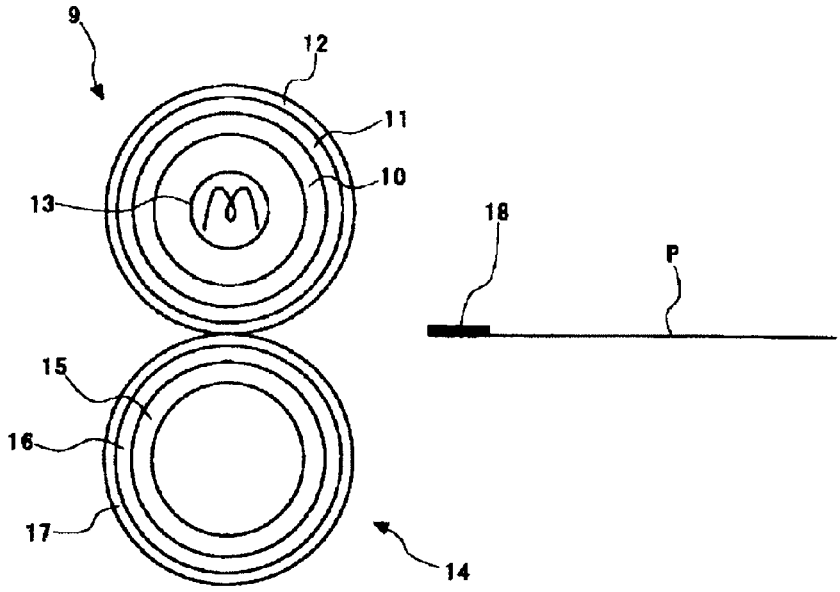
FIG. 3 illustrates one exemplary fixing unit used in an image forming apparatus of the present invention.

The fixing device may be a soft roller-type fixing device having fluorine-containing surface layers as illustrated in FIG. 3. This fixing unit has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an elastic material layer (16) of silicone rubber and a PFA surface layer (17), where the elastic material layer (16) and the PFA surface layer (17) are provided on the aluminum core (15). Notably, the recording paper sheet (P) having an unfixed image (18) is fed as illustrated.

Notably, in the present invention, a known optical fixing device may be used in addition to or instead of the fixing unit depending on the intended purpose.

Charge elimination is preferably performed by, for example, applying a charge-eliminating bias to the latent image bearing member with a charge-eliminating unit. The charge-eliminating unit is not particularly limited, so long as it can apply a charge-eliminating bias to the latent image bearing member, and may be appropriately selected from known charge-eliminating devices. Preferably, a charge-eliminating lamp or a similar device is used.

Cleaning is preferably performed by, for example, removing the toner remaining on the photoconductor with a cleaning unit. The cleaning unit is not particularly limited, so long as it can remove the toner remaining on the photoconductor, and may be appropriately selected from known cleaners. Preferred examples thereof include a magnetic blush cleaner, an electrostatic brush cleaner, a magnetic roller cleaner, a blade cleaner, a brush cleaner and a web cleaner.

Recycling is preferably performed by, for example, conveying the toner having been removed by the cleaning unit to the developing unit with a recycling unit. The recycling unit is not particularly limited and may be, for example, a known conveying unit.

Control is preferably performed by, for example, controlling each unit with a controlling unit. The controlling unit is not particularly limited, so long as it can control each unit, and may be appropriately selected depending on the intended purpose. Examples thereof include devices such as a sequencer and a computer.

The image forming apparatus, image forming method or process cartridge of the present invention uses the latent electrostatic image developing toner excellent in fixing property and involving no degradation (e.g., cracks) due to stress in the developing process, and thus can provide good images.

[Multi-Color Image Forming Apparatus]

Figure 4:
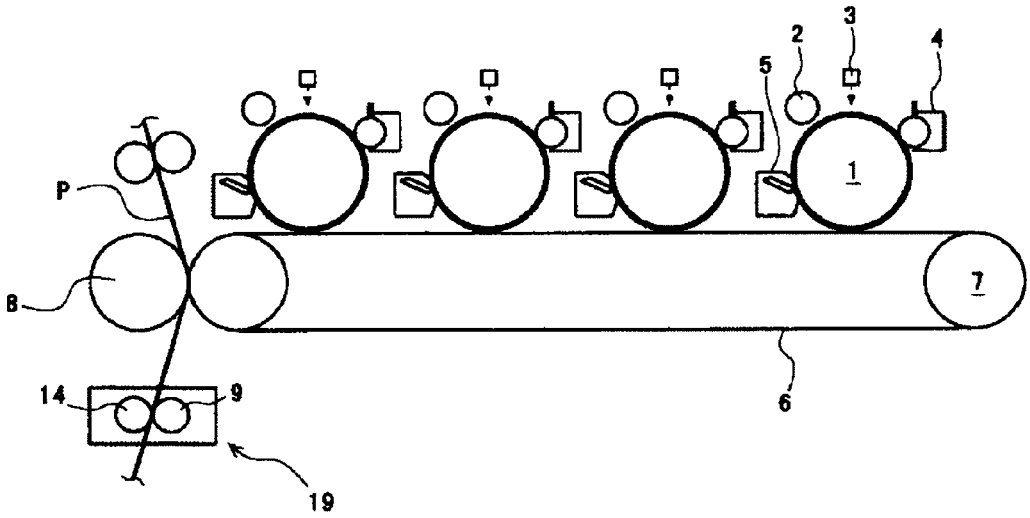
FIG. 4 is a schematic view of an example of a multi-color image forming apparatus to which the present invention is applied.

FIG. 4 is a schematic view of an example of a multi-color image forming apparatus to which the present invention is applied. The multi-color image forming apparatus illustrated in FIG. 4 is a tandem-type full color image forming apparatus.

The image forming apparatus of FIG. 4 contains, in an unillustrated main body casing, latent image bearing members (1) rotated clockwise in FIG. 4 which are each provided therearound with a charging device (2), an exposing device (3), a developing device (4), an intermediate transfer medium (6), a supporting roller (7), and a transfer roller (8). This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer medium (6) and the transfer roller (8), followed by fixing with a fixing unit (19). Before fed to therebetween, the recording paper sheet is retained with a pair of registration rollers so that it can be fed at a desired timing.

In this image forming apparatus, while being rotated clockwise in FIG. 4, each of the latent image bearing members (1) is uniformly charged with the corresponding charging device (2). Then, the latent image bearing member (1) is irradiated with laser beams modulated by image date from the corresponding exposing device (3), to thereby form a latent electrostatic image. The latent electrostatic image formed on the latent image bearing member (1) is developed with the toner using the corresponding developing device (4). Next, the toner image, which has formed by applying the toner to the latent image bearing member with the developing device (4), is transferred from the latent image bearing member (1) to the intermediate transfer medium. The above-described process is performed in four colors of cyan (C), magenta (M), yellow (Y) and black (K), to thereby form a full color toner image.

Figure 5:
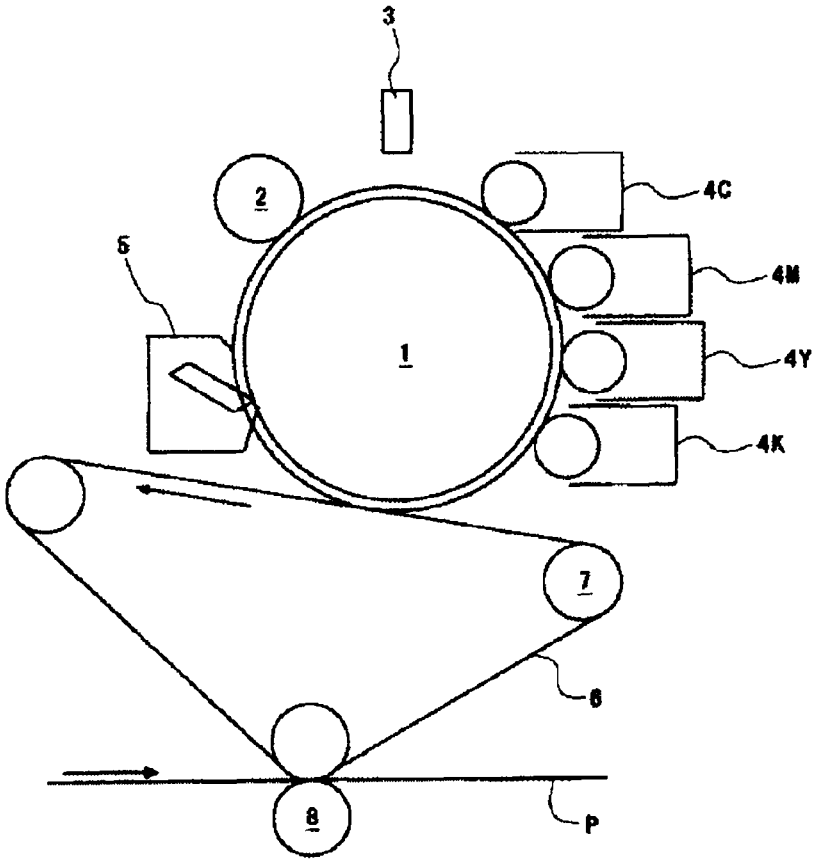
FIG. 5 is a schematic view of an example of a full color image forming apparatus of a revolver type.

FIG. 5 is a schematic view of an example of a full color image forming apparatus of a revolver type. This image forming apparatus switches the operation of each developing device to sequentially apply color toners onto one latent image bearing member (1) for development. A transfer roller (8) is used to transfer the color toner image from the intermediate transfer medium (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach a cleaning part (5) where the toner remaining on the surface of the latent image bearing member (1) is scraped off by a blade, followed by charge-eliminating. Then, the image forming apparatus uniformly charges, with the charging device (2), the latent image bearing member (1) charge-eliminated by the charge-eliminating device, and performs the next image formation in the same manner as described above. Notably, the cleaning part (5) is limited to the part where the toner remaining on the latent image bearing member (1) is scraped off by a blade. For example, the cleaning part (5) may be a part where the toner remaining on the latent image bearing member (1) is scraped off by a fur brush.

The image forming method or image forming apparatus of the present invention uses as a developer the toner of the present invention, and thus can provide good images.

<Process Cartridge>

A process cartridge of the present invention includes at least a latent electrostatic image bearing member and a developing unit configured to develop a latent electrostatic image on the latent electrostatic image bearing member with the toner of the present invention to form a visible image; and, if necessary, further includes appropriately selected other units such as a charging unit, a developing unit, a transfer unit, a cleaning unit and a charge-eliminating unit, wherein the process cartridge is detachably mounted to the main body of an image forming apparatus.

The developing unit has at least a developer container housing the toner or the developer of the present invention, and a developer bearing member which bears and conveys the toner or the developer housed in the developer container; and optionally includes, for example, a layer thickness-regulating member for regulating the layer thickness of the toner on the developer bearing member. The process cartridge of the present invention can be mounted detachably to various electrophotographic apparatuses, facsimiles and printers. Preferably, it is mounted detachably to the below-described image forming apparatus of the present invention.

Figure 6:
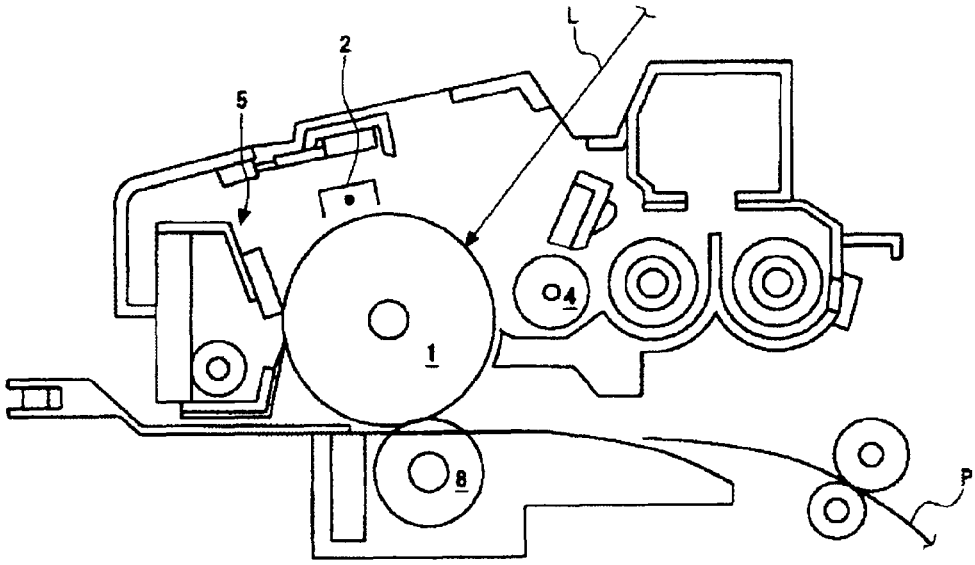
FIG. 6 illustrates one exemplary process cartridge of the present invention.

As illustrated in FIG. 6, the process cartridge includes a latent image bearing member (1), a charging device (2), a developing device (4), a transfer roller (8) and a cleaning part (5); and, if necessary, further includes other units. In FIG. 6, (L) denotes light emitted from an unillustrated exposing device and (P) denotes a recording paper sheet. The latent image bearing member (1) may be the same as that used in the above-described image forming apparatus. The charging device (2) may be any charging member.

Next, description will be given to image forming process by the process cartridge illustrated in FIG. 6. While being rotated clockwise, the latent image bearing member (1) is charged with the charging device (2) and then is exposed to light (L) emitted from the unillustrated exposing unit. As a result, a latent electrostatic image in response to an exposure pattern is formed on the surface of the latent image bearing member (1). The latent electrostatic image is developed with the toner in the developing device (4). The developed toner image is transferred with the transfer roller (8) onto the recording paper sheet (P), which is then printed out. Next, the latent image bearing member surface from which the toner image has been transferred is cleaned in the cleaning part (5), and is charge-eliminated with an unillustrated charge-eliminating unit. The above-described process is repeatedly performed.

<Measurement of Particle Diameter of Toner Particles>

The volume average particle diameter of the toner particles is measured by the Coulter counter method. Examples of employable measurement apparatus include a Coulter Counter TA-II, Coulter Multisizer II and Coulter Multisizer III (these products are of Coulter, Inc.). The measurement method will next be described.

First, a surfactant (0.1 mL to 5 mL), preferably an alkylbenzene sulfonic acic salt, is added as a dispersing agent to an electrolyte solution (100 mL to 150 mL). Here, the electrolyte solution is an about 1% aqueous NaCl solution prepared using 1st grade sodium chloride, and examples of commercially available products thereof include ISOTON-II (product of Coulter, Inc.). Subsequently, a measurement sample (2 mg to 20 mg) is suspended in the above-obtained electrolyte solution. The resultant electrolyte solution is dispersed with an ultrasonic wave disperser for about 1 min to about 3 min. The thus-obtained dispersion liquid is analyzed with the above-described apparatus using an aperture of 100 μm to measure the number or volume of the toner particles. Then, the volume particle size distribution and number particle size distribution are calculated from the obtained values. From these distributions, the volume average particle diameter and number average particle diameter of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

The toner particles of the present invention preferably have a volume average particle diameter of 3 μm to 9 μm, preferably 4 μm to 8 μm, more preferably 4 μm to 7 μm, in order for the toner particles to be changed uniformly and sufficiently. The toner particles having a volume average particle diameter less than 3 μm are relatively increased in toner adhesion force, which is not preferred since the toner operability is reduced under an electrical field. The toner particles having a volume average particle diameter exceeding 9 μm form an image whose image qualities (e.g., reproducibility of thin lines) are degraded.

Also, in the toner, the ratio of the volume average particle diameter to the number average particle diameter (volume average particle diameter/number average particle diameter) is preferably 1.25 or less, more preferably 1.20 or less, still more preferably 1.17 or less. When the ratio therebetween exceeds 1.25; i.e., the toner particles have low uniformity in particle diameter, the size of the protrusions tends to be varied. In addition, during repetitive use, toner particles having a large particle diameter or, in some cases, toner particles having small particle diameter are preferentially consumed, so that the average particle diameter of the toner particle remaining in the developing device is changed from that of the toner particles at an initial state. Thus, the developing conditions initially set are not optimal for development of the remaining toner particles. As a result, various unfavorable phenomena tend to occur including charging failure, considerable increase or decrease of the amount of toner particles conveyed, toner clogging and toner leakage.

<Measurement of Shape of Toner Particles>

The average sphericity of the toner can be measured using a flow-type particle image analyzer FPIA-2000. Specifically, 0.1 mL to 0.5 mL of a surfactant (preferably an alkylbenzene sulfonic acid salt) is added as a dispersing agent into 100 mL to 150 mL of water in a container, from which solid impurities have previously been removed. Then, about 0.1 g to about 0.5 g of a measurement sample is added to the container, followed by dispersing. The resultant suspension is subjected to dispersing treatment by an ultrasonic disperser for about 1 min to about 3 min, and the concentration of the dispersion liquid is adjusted such that the number of particles of the sample is 3,000 per microliter to 10,000 per microliter. In this state, the shape and distribution of the toner are measured using the analyzer.

The toner has an average sphericity of 0.930 or more, preferably 0.950 or more, more preferably 0.970 or more. The toner having an average sphericity less than 0.930 is poor in flowability to easily cause failures upon development as well as to be degraded in transfer efficiency.

<Measurement of Particle Diameter of Vinyl Fine Resin Particles>

The particle diameter of the fine resin particles was measured using UPA-150EX (product of NIKKISO CO., LTD.).

The fine resin particles have a particle diameter of 50 nm to 200 nm, preferably 80 nm to 160 nm, more preferably 100 nm to 140 nm. When the particle diameter is smaller than 50 nm, it is difficult to form sufficiently large protrusions on the toner surface. When the particle diameter exceeds 200 nm, the formed protrusions become ununiform, which is not preferred. Also, in the fine resin particles, the ratio of the volume average particle diameter to the number average particle diameter (volume average particle diameter/number average particle diameter) is preferably 1.25 or less, more preferably 1.20 or less, still more preferably 1.17 or less. When the particle diameter of the fine resin particles exceeds 1.25; i.e., the fine resin particles are poor in uniformity of particle diameter, the embedment rates of the formed fine resin particles tend to be varied.

<Measurement of Molecular Weight (GPC)>

The molecular weight of the resin was measured through GPC (gel permeation chromatography) under the following conditions.

Apparatus: GPC-150C (product of Waters Co.)
Column: KF801 to 807 (product of Shodex Co.)
Temperature: 40° C.
Solvent: THF (tetrahydrofuran)
Flow rate: 1.0 mL/min
Sample injected: 0.1 mL of a sample having a concentration of 0.05% to 0.6%

From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were toluene and Std. Nos. S-7300, S-210, S-390, S-875, S-1980, S-10.9, S-629, S-3.0 and S-0.580 of Showdex STANDARD (product of SHOWA DENKO K.K.). The detector used was a R1 (refractive index) detector.

<Measurement of Glass Transition Temperature (Tg) (DSC)>

The Tg was measured using TG-DSC system TAS-100 (product of Rigaku Denki Co., Ltd.).

A sample (about 10 mg) is placed in an aluminum container, which is placed on a holder unit. The holder unit is then set in an electric oven. The sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min for DSC analysis. Using the analysis system of TAS-100 system, the Tg is calculated from the tangent point between the base line and the tangential line of the endothermic curve near the Tg.

<Measurement of Acid Value>

The acid value of the resin is measured according to JIS K1557-1970, which will be specifically described below.

About 2 g of a pulverized sample is accurately weighed (W (g)).

The sample is added to a 200 mL conical flask. Then, 100 mL of a solvent mixture of toluene/ethanol (2:1) is added to the flask. The resultant mixture is left to stand for 5 hours for dissolution. A phenolphthalein solution serving as an indicator is added to the solution.

The resultant solution is titrated with 0.1N alcohol solution of potassium hydroxide. The amount of the KOH solution is defined as S (mL).

A blank test is performed, and the amount of the KOH solution is defined as B (mL).

The acid value is calculated using the following equation:

$$\text{Acid value}=[(S-B)\times f\times 5.61]/W$$

where f denotes a factor of the KOH solution.

<Measurement of Concentration of Solid Matter>

The concentration of solid matter contained in the oil phase was measured as follows.

An aluminum plate (about 1 g to about 3 g) is accurately weighed in advance. About 2 g of the oil phase is placed on the aluminum plate within 30 sec, and then the oil phase placed thereon is accurately weighed. The aluminum plate is placed for 1 hour in an oven set to 150° C. to evaporate the solvent. Thereafter, the aluminum plate is taken out from the oven and left to cool. Subsequently, the total mass of the aluminum plate and solid matter of the oil phase is measured with an electronic balance. The mass of the aluminum plate is subtracted from the total mass of the aluminum plate and the solid matter contained in the oil phase to obtain the mass of the solid matter contained in the oil phase, which is divided by the mass of the oil phase placed on the aluminum plate to obtain the concentration of the solid matter contained in the oil phase. Also, the ratio of the solvent to the solid matter contained in the oil phase is a value obtained from the following: (the mass of the oil phase—the mass of the solid matter contained in the oil phase); i.e., the mass of the solvent/the mass of the solid matter contained in the oil phase.

<Measurement of Average of Heights of Fine Resin Particles: D1, Average of Depths of Embedded Regions: D2, Average of Exposed Diameters: R1, Average of Opening Diameters: R1' and Coverage Rate of the Exposed Regions on the Surface of the Core Particle>

The average of heights of the fine resin particles (second resin): D1, the average of depths of the embedded regions: D2, the average of exposed diameters: R1, the average of opening diameters: R1', and the coverage rate of the exposed regions on the surface of the core particle are measured as follows.

An epoxy resin curable within 30 min is dropped on a stub specialized for an apparatus, and left to stand for 30 min. A sample is applied onto the epoxy resin and left to stand for one day or longer. The sample is cut with an ultramicrotome (product of Ultrasonic Co.) to form cross-sectional surfaces of toner particles. The cross-sectional surfaces are observed under a scanning transmission electron microscope (STEM) or Schottky field emission scanning transmission electron microscope (Schottky FE-SEM). The obtained cross-sectional images were processed using image analysis particle size distribution measurement software "Mac-View" (product of Mountech Co., Ltd.) to measure 100 or more fine resin particles embedded in the first resin for heights of the exposed regions of the fine resin particles: D1, depths of the embedded regions: D2, exposed diameters (longitudinal lengths) of the exposed regions: R1, and opening diameters (longitudinal lengths) of parts of the first resin in which the second resin is embedded: R1', to thereby calculate the averages thereof. One hundred or more toner particles are determined for an average and standard deviation of the coverage rates of the exposed regions on the surface of the core particle. The coverage rate of the exposed regions on the surface of the core particle as used herein is defined as a percentage of the total longitudinal length of the exposed regions relative to the circumferential length of a toner core particle.

EXAMPLES

The present invention will next be described by way of Examples, which should not be construed as limiting the present invention thereto. In the following Examples, the unit "part(s)" is part(s) by mass and the unit "%" is % by mass.

<Preparation Method of Fine Resin Particle Dispersion Liquid 1>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 1] having a volume average particle diameter of 135 nm. Subsequently, 2 mL of the thus-obtained [fine resin particle dispersion liquid 1] was added to a petri dish, where the dispersion medium was evaporated. The obtained dry product was measured for number average molecular weight, weight average molecular weight and Tg, which were found to be 8,300, 16,900 and 84° C., respectively.

<Preparation of Fine Resin Particle Dispersion Liquid 2>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (98 parts) was added to the resultant solution. Fifteen minutes after the addition, a monomer mixture of a styrene monomer (160 parts) and [compound 1] having the following chemical formula (40 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 2] having a volume average particle diameter of 115 nm. Subsequently, 2 mL of the thus-obtained [fine resin particle dispersion liquid 2] was added to a Petri dish, where the dispersion medium was evaporated. The obtained dry product was measured for number average molecular weight, weight average molecular weight and Tg, which were found to be 98,400, 421,900 and 70° C., respectively.

<Preparation Method of Fine Resin Particle Dispersion Liquid 3>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (98 parts) was added to the resultant solution. Fifteen minutes after the addition, a monomer mixture of a styrene monomer (130 parts) and [compound 1] having the following chemical formula (70 parts) was added dropwise to the resultant mixture for 90 min. Subsequently, the temperature of the mixture was maintained at 80° C. for 60 min to perform polymerization reaction.

compound 1

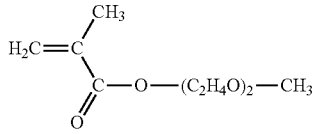

Then, the reaction mixture was cooled to obtain white [fine resin particle dispersion liquid 3] having a volume average particle diameter of 115 nm. Subsequently, 2 mL of the thus-obtained [fine resin particle dispersion liquid 3] was added to a petri dish, where the dispersion medium was evaporated. The obtained dry product was measured for number average molecular weight, weight average molecular weight and Tg, which were found to be 87,600, 391,700 and 48° C., respectively.

<Preparation Method of Fine Resin Particle Dispersion Liquid 4>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture of a styrene monomer (170 parts), butyl acrylate (30 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 4] having a volume average particle diameter of 135 nm. Subsequently, 2 mL of the thus-obtained [fine resin particle dispersion liquid 4] was added to a Petri dish, where the dispersion medium was evaporated. The obtained dry product was measured for number average molecular weight, weight average molecular weight and Tg, which were found to be 8,600, 17,300 and 55° C., respectively.

<Synthesis of Polyester 1>

A reaction container equipped with a condenser, a stirrer and a nitrogen-introducing pipe was charged with bisphenol A ethylene oxide 2 mol adduct (229 parts), bisphenol A propylene oxide 3 mol adduct (529 parts), terephthalic acid (208 parts), adipic acid (46 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg. Then, trimellitic anhydride (44 parts) was added to the reaction container, followed by reaction at 180° C. for 2 hours under normal pressure, to thereby synthesize [polyester 1]. The thus-obtained [polyester 1] was found to have a number average molecular weight of 2,500, a weight average molecular weight of 6,700, a glass transition temperature of 43° C. and an acid value of 25 mgKOH/g.

<Synthesis of Polyester 2>

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyl tinoxide (1 part), followed by reaction at 230° C. for 8 hours under normal pressure. Next, the reaction mixture was allowed to react for 8 hours under a reduced pressure of 10 mmHg to 15 mmHg. Then, trimellitic anhydride (26 parts) was added to the reaction container, followed by reaction at 180° C. for 2 hours under normal pressure, to thereby systhesize [polyester 2]. The thus-obtained [polyester 2] was found to have a number average molecular weight of 4,000, a weight average molecular weight of 47,000, a glass transition temperature of 65° C. and an acid value of 12 mgKOH/g.

<Synthesis of Isocyanate-Modified Polyester 1>

A reaction container equipped with a condenser, a stirrer and a nitrogen-introducing pipe was charged with bisphenol A ethylene oxide 2 mol adduct (682 parts), bisphenol A propylene oxide 2 mol adduct (81 parts), terephthalic acid (283 parts), trimillitic anhydride (22 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg, to thereby synthesize [intermediate polyester 1]. The thus-obtained [intermediate polyester 1] was found to have a number average molecular weight of 2,200, a weight average molecular weight of 9,700, a glass transition temperature of 54° C., an acid value of 0.5 mgKOH/g and a hydroxyl value of 52 mgKOH/g.

Next, a reaction container equipped with a condenser, a stirrer and a nitrogen-introducing pipe was charged with [intermediate polyester 1] (410 parts), isophorone diisocyanate (89 parts) and ethyl acetate (500 parts), followed by reaction at 100° C. for 5 hours, to thereby obtain [isocyanate-modified polyester 1].

<Preparation of Masterbatch>

Carbon black (REGAL 400R, product of Cabot Corporation) (40 parts), a binder resin (polyester resin) (60 parts) (RS-801, product of Sanyo Chemical Industries, Ltd., acid value: 10, Mw: 20,000, Tg: 64° C.) and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

Example 1

<Preparation Step of Oil Phase>

A container to which a stirring rod and a thermometer had been set was charged with [polyester 1] (545 parts), [paraffin wax (melting point: 74° C.)] (181 parts) and ethyl acetate (1,450 parts). The mixture was increased in temperature to 80° C. under stirring, maintained at 80° C. for 5 hours, and cooled to 30° C. for 1 hour. Then, the container was charged with [masterbatch 1] (500 parts) and ethyl acetate (100 parts), followed by mixing for 1 hour, to thereby obtain [raw material solution 1].

[Raw material solution 1] (1,500 parts) was placed in a container, where the pigment and the wax were dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, a 66% by mass ethyl acetate solution of [polyester 2] (655 parts) was added thereto, and passed once with the bead mill under the above conditions, to thereby obtain [pigment/wax dispersion liquid 1].

[Pigment/wax dispersion liquid 1] (976 parts) was mixed for 1 min at 5,000 rpm with a TK homomixer (product of Tokushu Kika Kogyo Co., Ltd.). Then, [isocyanate-modified polyester 1] (88 parts) was added to the [pigment/wax dispersion liquid 1]. The resultant mixture was mixed for 1 min at 5,000 rpm with a TK homomixer (product of Tokushu Kika Kogyo Co., Ltd.), to thereby obtain [oil phase 1]. Through measurement, the solid content of [oil phase 1] was found to be 52.0% by mass, and the amount of ethyl acetate in the solid content was found to be 92% by mass.

<Preparation of Aqueous Phase>

Ion-exchange water (970 parts), 40 parts of 25% by mass aqueous dispersion liquid of fine organic resin particles for stabilizing dispersion (a copolymer of styrene-methacrylic acid-butyl methacrylate-sodium salt of methacrylic acid ethylene oxide adduct sulfuric acid ester), 95 parts of 48.5% aqueous solution of sodium dodecyl diphenyl ether disulfonate and 98 parts of ethyl acetate were mixed together under stirring. The resultant mixture was found to have a pH of 6.2. Then, 10% aqueous solution of sodium hydroxide was added dropwise thereto to adjust the pH to 9.5, whereby [aqueous phase 1] was obtained.

<Production Step of Core Particles>

The obtained [aqueous phase 1] (1,200 parts) was added to [oil phase 1]. The resultant mixture was mixed for 2 min with a TK homomixer at 8,000 rpm to 15,000 rpm, while being adjusted to 20° C. to 23° C. in a water bath to suppress increase in temperature due to shear heat of the mixer. Thereafter, the mixture was stirred for 10 min at 130 rpm to 350 rpm using a three-one motor equipped with an anchor wing, to thereby obtain [core particle slurry 1] containing liquid droplets of the oil phase (core particles) in the aqueous phase.

<Formation of Protrusions>

First, [fine resin particle dispersion liquid 1] (106 parts) was mixed with ion-exchange water (71 parts). The resultant mixture (solid concentration: 15%) was added dropwise for 3 min to [core particle slurry 1] whose temperature was adjusted to 22° C. This addition was performed while [core particle slurry 1] was being stirred at 130 rpm to 350 rpm with a three-one motor equipped with an anchor wing. Thereafter, the mixture was further stirred for 30 min at 200 rpm to 450 rpm to obtain [composite particle slurry 1]. Then, 1 mL of [composite particle slurry 1] was diluted so as to have a volume of 10 mL, followed by centrifugation, whereby a transparent supernatant was obtained.

<Desolvation>

A container to which a stirrer and a thermometer had been set was charged with [composite particle slurry 1], which was desolvated with stirring at 30° C. for 8 hours to obtain [dispersion slurry 1]. A small amount of [dispersion slurry 1] was placed on a glass slide, and observed through a cover glass under an optical microscope (×200). As a result, uniform colored particles were observed. Also, 1 mL of [dispersion slurry 1] was diluted so as to have a volume of 10 mL, followed by centrifugation, whereby a transparent supernatant was obtained.

<Washing/Drying Step>

After [dispersion slurry 1] (100 parts) had been filtrated under reduced pressure, the following treatments (1) to (4) were performed.

(1) Ion-exchange water (100 parts) was added to the filtration cake, followed by mixing with a TK homomixer (at 12,000 rpm for 10 min) and filtrating.

(2) Ion-exchange water (900 parts) was added to the filtration cake obtained in (1). The resultant mixture was mixed with a TK homomixer (at 12,000 rpm for 30 min) under application of ultrasonic vibration, followed by filtrating under reduced pressure. This treatment was repeated until the reslurry had an electrical conductivity of 10 μC/cm or lower.

(3) 10% hydrochloric acid was added to the reslurry obtained in (2) so as to have a pH of 4, followed by stirring for 30 min with a three-one motor and filtrating.

(4) Ion-exchange water (100 parts) was added to the filtration cake obtained in (3), followed by mixing with a TK homomixer (at 12,000 rpm for 10 min) and filtrating. This treatment was repeated until the reslurry had an electrical conductivity of 10 μC/cm or lower, to thereby obtain [filtration cake 1].

[Filtration cake 1] was dried with an air-circulation dryer at 45° C. for 48 hours, and then sieved with a mesh having an opening size of 75 μm to obtain [toner base 1]. Through observation of the obtained [toner base 1] under a scanning electron microscope, the vinyl resin was found to be uniformly fused with the surfaces of the core particles.

<Flattening Step of Exposed Regions>

The obtained [toner base 1] (100 parts) was charged into HENSCHEL MIXER, and mixed at 5,000 rpm for 30 min under stirring to obtain [post-treatment toner base 1]. Through observation of the obtained [post-treatment toner base 1] under a scanning electron microscope, flattened vinyl resin was found to be ununiformly fused with the surfaces of the core particles.

<Attachment Step of Additives>

[Post-treatment toner base 1] (100 parts) and silica fine powder (1.5 parts) (RX50, product of Nippon Aerosil Co., Ltd.; average primary particle diameter: 40 μm) were mixed together using HENSCHEL MIXER. The resultant mixture was caused to pass through a sieve with an opening size of 60 μm to remove coarse particles and aggregates, whereby [toner 1] was obtained.

Example 2

[Toner 2] was obtained in the same manner as in Example 1, except that [fine resin particle dispersion liquid 1] was changed to [fine resin particle dispersion liquid 2] in the flattening step of the exposed regions. A post-treatment toner base obtained in Example 2 is referred to as [post-treatment toner base 2].

Example 3

[Toner 3] was obtained in the same manner as in Example 1, except that the amount of the 48.5% aqueous solution of sodium dodecyl diphenyl ether disulfonate was changed from 95 parts to 285 parts in the preparation of the aqueous phase. A post-treatment toner base obtained in Example 3 is referred to as [post-treatment toner base 3].

Example 4

[Toner 4] was obtained in the same manner as in Example 1, except that the treatment time was changed from 30 min to 2 min in the flattening step of the exposed regions. A post-treatment toner base obtained in Example 4 is referred to as [post-treatment toner base 4].

Example 5

[Toner 5] was obtained in the same manner as in Example 1, except that the amount of [fine resin particle dispersion liquid 1] was changed from 106 parts to 20 parts in the formation of protrusions. A post-treatment toner base obtained in Example 5 is referred to as [post-treatment toner base 5].

Example 6

[Toner 6] was obtained in the same manner as in Example 1, except that [fine resin particle dispersion liquid 1] was changed to [fine resin particle dispersion liquid 3] in the formation of protrusions. A post-treatment toner base obtained in Example 6 is referred to as [post-treatment toner base 6].

Example 7

[Toner 7] was obtained in the same manner as in Example 1, except that the amount of [fine resin particle dispersion liquid 1] was changed from 106 parts to 530 parts, and the 48.5% aqueous solution of sodium dodecyl diphenyl ether disulfonate (190 parts) was added dropwise at the same time with [fine resin particle dispersion liquid 1].

A post-treatment toner base obtained in Example 7 is referred to as [post-treatment toner base 7].

Example 8

[Toner 8] was obtained in the same manner as in Example 1, except that [fine resin particle dispersion liquid 1] was added to [aqueous phase 1] in the preparation of aqueous phase, and [fine resin particle dispersion liquid 1] was not added in the formation of protrusions. A post-treatment toner base obtained in Example 8 is referred to as [post-treatment toner base 8].

Example 9

[Toner 9] was obtained in the same manner as in Example 1, except that [fine resin particle dispersion liquid 1] was changed to [fine resin particle dispersion liquid 4] in the formation of protrusions. A post-treatment toner base obtained in Example 9 is referred to as [post-treatment toner base 9].

Example 10

[Toner 10] was obtained in the same manner as in Example 1, except that [isocyanate-modified polyester 1] was not added in the preparation step of the oil phase. A post-treatment toner base obtained in Example 10 is referred to as [post-treatment toner base 10].

Example 11

[Toner 11] was obtained in the same manner as in Example 1, except that the amount of the 48.5% aqueous solution of sodium dodecyl diphenyl ether disulfonate was changed from 95 parts to 475 parts in the preparation of the aqueous phase. A post-treatment toner base obtained in Example 11 is referred to as [post-treatment toner base 11].

Example 12

[Toner 12] was obtained in the same manner as in Example 1, except that the treatment time was changed from 30 min to 30 sec in the flattening step of the exposed regions. A post-treatment toner base obtained in Example 12 is referred to as [post-treatment toner base 12].

Example 13

[Toner 13] was obtained in the same manner as in Example 1, except that the amount of [fine resin particle dispersion liquid 1] was changed from 106 parts to 5 parts in the formation of protrusions. A post-treatment toner base obtained in Example 13 is referred to as [post-treatment toner base 13].

Example 14

[Toner 14] was obtained in the same manner as in Example 1, except that the silica fine powder RX50 was changed to silica fine powder OX50 (product of Nippon Aerosil Co., Ltd.; average primary particle diameter: 40 μm) in the attachment step of additives. A post-treatment toner base obtained in Example 14 is referred to as [post-treatment toner base 14].

Comparative Example 1

[Toner 15] was obtained in the same manner as in Example 1, except that [fine resin particle dispersion liquid 1] was not added in the formation of protrusions. A post-treatment toner base obtained in Example 15 is referred to as [post-treatment toner base 15]. A post-treatment toner base obtained in Comparative Example 1 is referred to as [post-treatment toner base 15].

Comparative Example 2

[Toner 16] was obtained in the same manner as in Example 1, except that the amount of the 48.5% aqueous solution of sodium dodecyl diphenyl ether disulfonate was changed from 95 parts to 125 parts in the preparation of the aqueous phase, and the flattening step of exposed regions was not performed. A post-treatment toner base obtained in Comparative Example 2 is referred to as [post-treatment toner base 16].

Comparative Example 3

[Toner 17] was obtained in the same manner as in Comparative Example 1, except that the below-described <Formation of exposed regions and flattening step of exposed regions> was performed instead of the flattening step of exposed regions.

<Formation of Exposed Regions and Flattening Step of Exposed Regions>

[Toner base 15] (100 parts) obtained in Comparative Example 1 and the dry product of [fine resin particle dispersion liquid 1] (20 parts) were mixed together under stirring using HENSCHEL MIXER at 5,000 rpm for 30 min.

Each [post-treatment toner base] (20 g) and acrylic resin beads (30 g) were charged into a 100 mL-polyethylene bottle, and then rotated using a roll mill for 24 hours under stirring to obtain a pseudodegraded toner. Each toner obtained in Examples and Comparative Examples above and the pseudodegraded toner were evaluated for a change of the toner properties before and after degradation. These results are summarized in Tables 1, 2-1 and 2-2.

TABLE 1

| | D2/D1 | R1/D1 | R1/R1' | Coverage rate of protrusions on the surface of the core particle | | Embedment rate of protrusions |
|---|---|---|---|---|---|---|
| | | | | Average (%) | Standard deviation | |
| Ex. 1 | 2.8 | 4.2 | 1.5 | 72 | 3.5 | 74 |
| Ex. 2 | 3.3 | 4.8 | 1.4 | 76 | 5.8 | 76 |
| Ex. 3 | 1.5 | 3.4 | 1.2 | 69 | 8.8 | 60 |
| Ex. 4 | 2.2 | 3.2 | 1.8 | 59 | 4.5 | 69 |
| Ex. 5 | 2.8 | 4.0 | 1.6 | 38 | 3.2 | 73 |
| Ex. 6 | 4.5 | 4.9 | 1.5 | 44 | 7.3 | 82 |
| Ex. 7 | 1.2 | 3.8 | 1.3 | 98 | 9.3 | 55 |
| Ex. 8 | 1.8 | 4.0 | 1.5 | 69 | 8.2 | 64 |
| Ex. 9 | 3.9 | 5.2 | 1.5 | 32 | 2.5 | 80 |
| Ex. 10 | 2.6 | 3.9 | 1.5 | 75 | 3.2 | 72 |
| Ex. 11 | 0.8 | 1.4 | 1.1 | 55 | 11.3 | 44 |
| Ex. 12 | 1.3 | 2.6 | 1.2 | 62 | 3.4 | 57 |
| Ex. 13 | 2.7 | 3.8 | 1.5 | 23 | 2.0 | 73 |
| Ex. 14 | 2.8 | 4.2 | 1.5 | 72 | 3.5 | 74 |
| Comp. Ex. 1 | — | — | — | — | — | |
| Comp. Ex. 2 | 0.9 | 1.7 | 1.0 | 56 | 3.6 | 47 |
| Comp. Ex. 3 | 0.1 | 1.4 | 1.0 | 63 | 14.6 | 12 |

TABLE 2-1

| | Background smear | Adhesion resistance | Transferre rate | Transfer unevenness | Halftone producibility | Change of image density |
|---|---|---|---|---|---|---|
| Ex. 1 | AA | AA | AA | AA | AA | AA |
| Ex. 2 | AA | AA | AA | AA | AA | AA |
| Ex. 3 | A | AA | AA | AA | AA | AA |
| Ex. 4 | AA | AA | AA | AA | AA | AA |
| Ex. 5 | A | AA | AA | AA | AA | AA |
| Ex. 6 | AA | AA | AA | AA | AA | AA |
| Ex. 7 | A | AA | AA | AA | AA | AA |
| Ex. 8 | A | AA | AA | AA | AA | AA |
| Ex. 9 | A | AA | AA | AA | AA | AA |
| Ex. 10 | AA | AA | AA | AA | AA | AA |
| Ex. 11 | A | AA | AA | AA | AA | AA |
| Ex. 12 | A | AA | A | A | A | B |
| Ex. 13 | A | AA | A | A | A | A |
| Ex. 14 | A | AA | AA | AA | A | C |
| Comp. Ex. 1 | C | C | A | B | B | B |
| Comp. Ex. 2 | A | AA | C | C | C | B |
| Comp. Ex. 3 | C | C | C | C | C | C |

TABLE 2-2

| | Minimum fixing temperature | Hot offset | Cleanability | Charging roller smear | Photoconductor abrasion |
|---|---|---|---|---|---|
| Ex. 1 | AA | AA | A | AA | AA |
| Ex. 2 | AA | AA | A | AA | AA |
| Ex. 3 | AA | AA | A | AA | AA |
| Ex. 4 | AA | AA | A | AA | AA |
| Ex. 5 | AA | AA | A | AA | AA |
| Ex. 6 | AA | AA | A | AA | AA |
| Ex. 7 | AA | AA | A | AA | AA |
| Ex. 8 | AA | AA | A | AA | AA |
| Ex. 9 | AA | AA | A | AA | AA |
| Ex. 10 | AA | AA | A | AA | AA |
| Ex. 11 | AA | AA | A | AA | A |
| Ex. 12 | AA | AA | A | AA | AA |
| Ex. 13 | AA | AA | A | AA | AA |
| Ex. 14 | AA | AA | A | AA | AA |
| Comp. Ex. 1 | AA | AA | B | AA | AA |
| Comp. Ex. 2 | AA | AA | A | C | A |
| Comp. Ex. 3 | AA | AA | A | C | C |

From the above results, it is understood that the toner of the present invention is excellent in chargeability, developing durability, adhesion resistance, transferability, cleanability, heat resistance storage stability and low-temperature fixing property, and can form high-quality images. Thus, the toner of the present invention is suitable as a toner used in image forming apparatuses such as electronic copiers, printers and facsimiles.

The embodiments of the present invention are as follows.

<1> An electrostatic image developing toner including: toner particles;

wherein the toner particles each contain: a core particle including a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of R1>R1' where, in a cross-section of the toner particle, R1' denotes an average diameter of openings of the first resin in which the second resin is embedded and R1 denotes an average diameter of the exposed regions.

<2> The electrostatic image developing toner according to <1>, wherein each toner particle satisfies an expression of D2/D1≥1 where, in the cross-section of the toner particle, D1 denotes an average height of the exposed regions of the second resin and D2 denotes an average depth of the embedded regions of the second resin.

<3> The electrostatic image developing toner according to <1> or <2>, wherein each toner particle satisfies an expression of 3 R1/D1 where D1 denotes an average height of the exposed regions of the second resin in the cross-section of the toner particle.

<4> The electrostatic image developing toner according to any one of <1> to <3>, wherein a coverage rate of the exposed regions on the surface of the core particle is 30% to 100%.

<5> The electrostatic image developing toner according to any one of <1> to <4>, wherein a standard deviation of coverage rates of the exposed regions on the surface of the core particle is 10 or less.

<6> The electrostatic image developing toner according to any one of <1> to <5>, wherein a rate of a mass of the fine resin particles relative to a total mass of the core particle and the fine resin particles is 1% to 20%.

<7> The electrostatic image developing toner according to any one of <1> to <6>, wherein the electrostatic image developing toner is obtained through a process including producing the core particles, and attaching and fusing the fine resin particles on the surfaces of the core particles.

<8> The electrostatic image developing toner according to any one of <1> to <7>, wherein the first resin is a polyester resin.

<9> The electrostatic image developing toner according to any one of <1> to <8>, wherein the second resin is a vinyl resin.

<10> The electrostatic image developing toner according to any one of <1> to <9>, wherein an amount of a styrene monomer among monomers forming the second resin is 80% by mass to 100% by mass.

<11> The electrostatic image developing toner according to any one of <1> to <10>, wherein an amount of an acid monomer-derived site among monomer-derived sites forming the second resin is 0% by mass.

<12> The electrostatic image developing toner according to any one of <1> to <11>, wherein the core particles each further contain a modified polyester resin containing at least one of a urethane group and a urea group.

<13> The electrostatic image developing toner according to any one of <1> to <12>, wherein the core particles each further contain a releasing agent.

<14> The electrostatic image developing toner according to any one of <1> to <13>, wherein the electrostatic image developing toner further contains as an additive fine silica particles whose surfaces have been hydrophobized.

<15> A toner container including:

the electrostatic image developing toner according to any one of <1> to <14>, and a container, which houses the electrostatic image developing toner.

<16> A developer including:

the electrostatic image developing toner according to any one of <1> to <14>.

<17> An image forming apparatus including:

a latent image bearing member which bears a latent image thereon, a charging unit configured to uniformly charge a surface of the latent image bearing member, an exposing unit configured to expose the charged surface of the latent image bearing member based on image data to form a latent electrostatic image, a toner for visualizing the latent image, a developing device configured to supply a toner to the latent electrostatic image formed on the surface of the latent image bearing member and develop the latent electrostatic image, a transfer unit configured to transfer, onto an image-receiving medium, the visible image on the surface of the latent image bearing member, and a fixing unit configured to fix the visible image on the image-receiving medium, wherein the toner is the electrostatic image developing toner according to any one of <1> to <14>.

<18> An image forming method including:

uniformly charging a surface of a latent image bearing member, exposing the charged surface of the latent image bearing member based on image data to form a latent electrostatic image, developing the latent electrostatic image formed on the surface of the latent image bearing member to form a visible image, transferring, onto an image-receiving medium, the visible image on the surface of the latent image bearing member, and fixing the visible image on the image-receiving medium, wherein the electrostatic image developing toner according to any one of <1> to <14> is used in the developing.

<19> A process cartridge including:

a latent image bearing member, a developing device configured to develop, with a developer, a latent image on the latent image bearing member, the latent image bearing member and the developing unit being integrally supported in the process cartridge which is mounted detachably to an image forming apparatus, wherein the developer contains the electrostatic image developing toner according to any one of <1> to <14>.

This application claims priority to Japanese application No. 2011-059679, filed on Mar. 17, 2011, and incorporated herein by reference.

What is claimed is:

1. An electrostatic image developing toner comprising:

toner particles;

wherein the toner particles each contain: a core particle comprising a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of $R1>R1'$ where, in a cross-section of the toner particle, $R1'$ denotes an average diameter of openings of the first resin in which the second resin is embedded and $R1$ denotes an average diameter of the exposed regions.

2. The electrostatic image developing toner according to claim 1, wherein each toner particle satisfies an expression of $D2/D1\geq 1$ where, in the cross-section of the toner particle, $D1$ denotes an average height of the exposed regions of the second resin and $D2$ denotes an average depth of the embedded regions of the second resin.

3. The electrostatic image developing toner according to claim 1, wherein each toner particle satisfies an expression of $3\leq R1/D1$ where $D1$ denotes an average height of the exposed regions of the second resin in the cross-section of the toner particle.

4. The electrostatic image developing toner according to claim 1, wherein a coverage rate of the exposed regions on the surface of the core particle is 30% to 100%.

5. The electrostatic image developing toner according to claim 1, wherein a standard deviation of coverage rates of the exposed regions on the surface of the core particle is 10 or less.

6. The electrostatic image developing toner according to claim 1, wherein a rate of a mass of the fine resin particles relative to a total mass of the core particle and the fine resin particles is 1% to 20%.

7. The electrostatic image developing toner according to claim 1, wherein the electrostatic image developing toner is obtained through a process including producing the core particles, and attaching and fusing the fine resin particles on the surfaces of the core particles.

8. The electrostatic image developing toner according to claim 1, wherein the first resin is a polyester resin.

9. The electrostatic image developing toner according to claim 1, wherein the second resin is a vinyl resin.

10. The electrostatic image developing toner according to claim 1, wherein an amount of a styrene monomer among monomers forming the second resin is 80% by mass to 100% by mass.

11. The electrostatic image developing toner according to claim 1, wherein an amount of an acid monomer-derived site among monomer-derived sites forming the second resin is 0% by mass.

12. The electrostatic image developing toner according to claim 1, wherein the core particles each further contain a modified polyester resin containing at least one of a urethane group and a urea group.

13. The electrostatic image developing toner according to claim 1, wherein the core particles each further contain a releasing agent.

14. The electrostatic image developing toner according to claim 1, wherein the electrostatic image developing toner further contains as an additive fine silica particles whose surfaces have been hydrophobized.

15. A toner container comprising:

the electrostatic image developing toner according to claim 1, and a container, which houses the electrostatic image developing toner.

16. A process cartridge comprising:

a latent image bearing member, a developing device configured to develop, with a developer, a latent image on the latent image bearing member, the latent image bearing member and the developing unit being integrally supported in the process cartridge which is mounted detachably to an image forming apparatus, wherein the developer contains an electrostatic image developing toner comprising:

toner particles;

wherein the toner particles each contain: a core particle comprising a first resin and a colorant; and fine resin particles each formed of a second resin and existing in a surface of the core particle, wherein part of each fine resin particle is embedded in the core particle to form an embedded region, and the remaining part of the fine resin particle is exposed on the surface of the core particle to form an exposed region, and wherein each toner particle satisfies an expression of $R1>R1'$ where, in a cross-section of the toner particle, $R1'$ denotes an average diameter of openings of the first resin in which the second resin is embedded and $R1$ denotes an average diameter of the exposed regions.

* * * * *